US010280065B2

(12) United States Patent
Shaw

(10) Patent No.: US 10,280,065 B2
(45) Date of Patent: May 7, 2019

(54) FUEL CONTAINER

(71) Applicant: Timothy James Shaw, Peach Tree City, GA (US)

(72) Inventor: Timothy James Shaw, Peach Tree City, GA (US)

(73) Assignee: FUELHOSS, LLC, Marietta, GA (US)

( * ) Notice: Subject to any disclaimer, the term of this patent is extended or adjusted under 35 U.S.C. 154(b) by 0 days.

(21) Appl. No.: 16/063,967

(22) PCT Filed: Mar. 15, 2018

(86) PCT No.: PCT/US2018/022691
§ 371 (c)(1),
(2) Date: Jun. 19, 2018

(87) PCT Pub. No.: WO2018/170294
PCT Pub. Date: Sep. 20, 2018

(65) Prior Publication Data

US 2019/0106314 A1 Apr. 11, 2019

Related U.S. Application Data

(60) Provisional application No. 62/471,808, filed on Mar. 15, 2017.

(51) Int. Cl.

| | |
|---|---|
| ***B65D 1/20*** | (2006.01) |
| ***B67D 7/00*** | (2010.01) |
| ***B67D 7/04*** | (2010.01) |
| ***B65D 21/02*** | (2006.01) |
| ***B65D 25/46*** | (2006.01) |
| ***B65D 85/84*** | (2006.01) |

(52) U.S. Cl.
CPC ..... *B67D 7/04* (2013.01); *B65D 1/20* (2013.01); *B65D 21/0204* (2013.01); *B65D 25/46* (2013.01); *B67D 7/005* (2013.01); *B65D 85/84* (2013.01); *B65D 2205/00* (2013.01)

(58) Field of Classification Search
CPC . B67D 7/04; B67D 7/005; B65D 1/20; B65D 21/0204; B65D 25/46; B65D 85/84; B65D 2205/00
USPC ..... 222/468
See application file for complete search history.

(56) References Cited

U.S. PATENT DOCUMENTS 3,097,674 A 7/1963 Allen
3,727,807 A * 4/1973 Flider ..... B65D 1/20 215/396
4,645,099 A 2/1987 Gillispie et al.
(Continued)

*Primary Examiner* — Jeremy Carroll
(74) *Attorney, Agent, or Firm* — Cozen O'Connor

(57) ABSTRACT

A fluid container having a body, a handle arranged in a top section of the body, a flow trigger in the handle, and a safety trigger that interacts with the flow trigger and prevents activation of the flow trigger. A vent assembly is arranged in the body and is configured to b activated by the safety trigger to vent the body. A spout assembly is movably coupled to the body and rotates between a use position and a storage position. A first valve opens as the spout assembly is moved from the storage position to the use position and a second valve is arranged upstream of the first valve to control fluid flow into the spout assembly. A linkage mechanism is arranged between th flow trigger and the second valve and configured to open the second valve when the flow trigger is activated and the safety trigger is released.

21 Claims, 29 Drawing Sheets

(56) References Cited

U.S. PATENT DOCUMENTS

| | | | | |
|---|---|---|---|---|
| 5,944,224 | A * | 8/1999 | Hodge | A47J 36/08 222/131 |
| 6,045,013 | A | 4/2000 | Yang | |
| 10,023,367 | B1 * | 7/2018 | Boucher | B65D 47/249 |
| 10,077,145 | B1 * | 9/2018 | Boucher | B65D 47/247 |
| 2009/0032556 | A1 | 2/2009 | Zwahlen | |
| 2009/0090745 | A1 | 4/2009 | Forbis | |
| 2012/0048895 | A1 | 3/2012 | Carter et al. | |
| 2013/0068800 | A1 * | 3/2013 | Ouderkirk | B67D 7/005 222/534 |
| 2015/0102054 | A1 | 4/2015 | Ouderkirk | |

* cited by examiner

DETAIL C

FUEL CONTAINER

PRIORITY CLAIM

This is a U.S. national stage of application No. PCT/US2018/022691, filed on Mar. 15, 2018. Priority is claimed on UNITED STATES, Application No. 62/471,808, filed Mar. 15, 2017, the content of which is incorporated herein by reference.

BACKGROUND OF THE INVENTION

1. Field of the Invention

This invention generally relates to portable containers for liquids. More particularly, the invention relates to a portable container that includes a pour spout. Specifically, the invention relates to a pour spout for a portable fuel container that includes a venting valve, and a valve assembly for sealing the spout when the container is not in use.

2. Description of the Related Art

Portable fuel containers are generally used to transport fuel from a fuel station pump to a device when it would be impractical or impossible to directly access the fuel station pump with the device. For example, one may desire to fill gasoline engine powered devices such as landscaping equipment, all-terrain vehicle, off-road vehicle, and so on with fuel, but it is impractical or burdensome to transport such devices to a gas station to be filled. On the other hand, portable fuel containers may be filled up at a gas station pump and then transported to the desired fuel engine.

Portable fuel containers are also useful for the temporary storage of fuel, such as when gasoline is siphoned from a fuel tank during maintenance or repair. In those circumstances, the fuel is transferred into the portable fuel container and may be dispensed into other devices or returned to the original device after the maintenance is complete.

Typical portable fuel containers are constructed from plastic with a capped opening for easily filling the container and storing fuel. These portable containers may include a separate spout for dispensing the fuel into the desired equipment. However, portable fuel containers are often susceptible to spillage when dispensing fuel as the result of imprecise human operation and the difficulty in handling heavy containers (e.g. when users tilt the containers to drain them). Additionally, it is typically difficult to empty all the fuel in conventional portable fuel containers, which can result in wasted fuel.

The most common technique to refill such a container is to unscrew and remove the spout assembly to expose the open container or via a second opening having a closable top provided for refilling purposes.

Self-venting containers, particularly fuel containers, are known. Due to governmental regulations relating to fuel containers, such containers have a discharge valve that prevents the escape of the contents of the container unless a user activates a mechanism. Often, the activation mechanism is difficult to use when holding a container steady with liquid disposed therein and simultaneously pouring the contents from the container into a desired location, such as a fuel tank.

There is a need for a self-venting container that is easy to use, has an acceptable flow rate, contains all required safety features, includes a spout that can stow on an outside of the container, a spout locking and unlocking mechanism, and a trigger-safety mechanism to prevent accidental activation of the discharge trigger.

SUMMARY OF THE INVENTION

A Portable Fuel Container (PFC) is disclosed. The PFC is constructed of industry standard materials known for safe fuel transport such as by methods of blow molding and injection molding. Typically, blow molding is used for the body and injection molding is used for the internal components of the PFC.

The present invention is directed to a portable fuel container having a spout, trigger, and safety features. While the spout, trigger, and safety features of the container are specifically designed to meet regulations relating to portable fuel containers, it will be understood that the portable container can be used for transporting other liquids beside fuel.

The PFC is designed so that an outlet valve system is positioned at a bottom front edge. There is a multi-function pressure relieve/air vent/safety trigger incorporated into a molded handle assembly. This trigger, when engaged, works to safely relieve excess internal pressure. There is a safety mechanism built into the trigger to help prevent accidental venting of internal fumes. Separate from the safety/vent trigger is a flow control actuator, which is found on the top side of the molded handle assembly, which is at a top of the PFC. When the flow control actuator is or engaged by the user, the flow valve opens, allowing fuel to exit the container.

Preferably, different volume PFCs share a similar profile, differing only in width. In this manner, the components other than the blow molded body can be utilized in the different volume PFCs to provide economies of scale in production.

According to one aspect of the invention, as a safety measure, and to prevent accidental spillage, the flow actuator cannot be engaged unless the safety trigger/air vent is engaged by a separate user action, i.e. a user action in addition to trigger activation.

According to one aspect of the invention, an additional safety feature built into the PFC prevents fuel from entering the pour spout when the spout is in a full "closed" storage position. This is achieved by incorporating a rotational valve into the internal components. Additionally, a diaphragm may be provided.

According to one aspect of the invention, the end user can control the flow speed by adjusting a flow rate control located on the end of the spout, ranging from "Full Open" to "Full Closed".

According to one aspect of the invention the fluid container comprises a body having a pair of opposite sidewall regions, a front wall connecting the pair of opposite sidewall regions, a rear wall connecting the pair of opposite sidewall regions, a top section comprising a sealable opening, and a base section opposite the top section. A handle is arranged on the top section and includes a flow trigger and a safety trigger, with the latte configured to interact with the flow trigger and prevent activation of the flow trigger. The top section includes a vent assembly that is activated by the safety trigger to vent the body. A spout assembly is movably coupled to the body. The spout assembly rotates between a use position and a storage position. The spout assembly includes a hollow tubular portion, a lock mechanism that couples the spout to the body, and a first valve configured to open from a closed position, when the spout assembly is in the storage position, to a fully open position, when the spout assembly is in the use position, as the spout assembly is moved from the storage position to the use position. Fluid flow is prevented by at least the first valve when the spout assembly is in the storage position. A second valve is arranged upstream of the first valve to control fluid flow into the spout assembly. A linkage mechanism is coupled between the flow trigger and the second valve to open the second valve when the flow trigger is activated and the safety trigger is released.

According to one aspect of the invention the safety trigger engages the flow trigger to prevent movement of the flow trigger. The flow trigger is slidably coupled to the handle and the safety trigger is pivotably coupled to the handle and configured to engage with the flow trigger to prevent sliding movement of the flow trigger.

Other end user benefits to the new PFC design include an easy-to-read fill line on a side of the container, vertical and horizontal stackability, and a modular design so that containers of different volumes can stack safely so that smaller volume containers can stack on top of larger containers. For example, a 2 gallon PFC can safely stack onto a 5 gallon PFC for safe storage.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION

Figure 1:
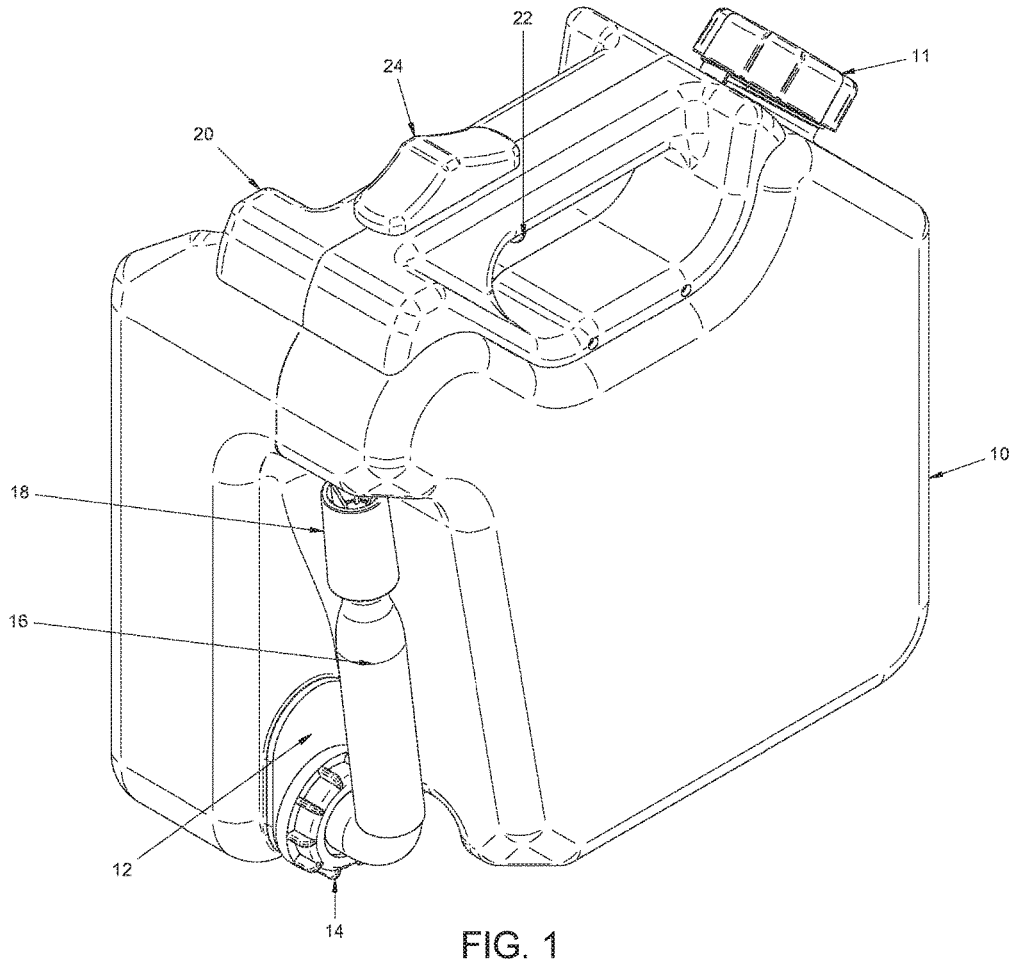
FIG. 1 is a front perspective view of a Portable Fuel Container (PFC)

FIGS. 1-6 are views of a Portable Fuel Container (PFC). FIG. 1 is a front perspective view of the PFC. The PFC has a body 10. Typically the body 10 is blow molded as a single element. An injection molded spout plate 12 is affixed to the body 10. Preferably, high density polyethelene (HDPE) or the like is used for the various molded components. Preferably, the spout plate 12 is attached to the body 10 by an ultrasonic welded seam. Alternatively, the spout plate 12 is attached to the body 10 by adhesives or the like. In one embodiment, the spout plate is formed with the body 10. According to one aspect of the invention, the spout plate 12 is comolded with the body 10. The spout plate 12 is arranged at a lower edge of the body 10. A spout 16 is coupled to the body 10 at the spout plate 12. The spout 16 is locked in place by a lock nut 14. The spout 16 is configured to rotate from a storage position shown in FIG. 1 to a use position, shown for example in FIG. 16. In one embodiment, the spout 16 can rotate approximately 180° from its storage position to its use position. A flow control tip 18 is fixed at a distal end of the spout 16 and configured to rotate to vary the output flow of the spout 16 from "full open" to "sealed".

A handle 20, typically an injection molded component, is affixed to a top of the body 10. The handle 20 is affixed to the body 10 by ultrasonic welding, adhesives, comolding, or the like. An actuator 24 is arranged at the handle 20. The actuator 24 is used to start and stop a flow through spout 16 as discussed below. A safety 22 is attached to the handle 20. The safety 22 prevents actuator 24 from being accidently engaged.

When the spout 16 is in the storage position shown in FIG. 1 it is arranged in a recess in the body 10. Preferably, in the storage position the spout does not extend beyond the walls that define the recess. In this manner, multiple PFCs can be stacked next to each other saving space and without the risk of the spout 16 being damaged.

Figure 2:
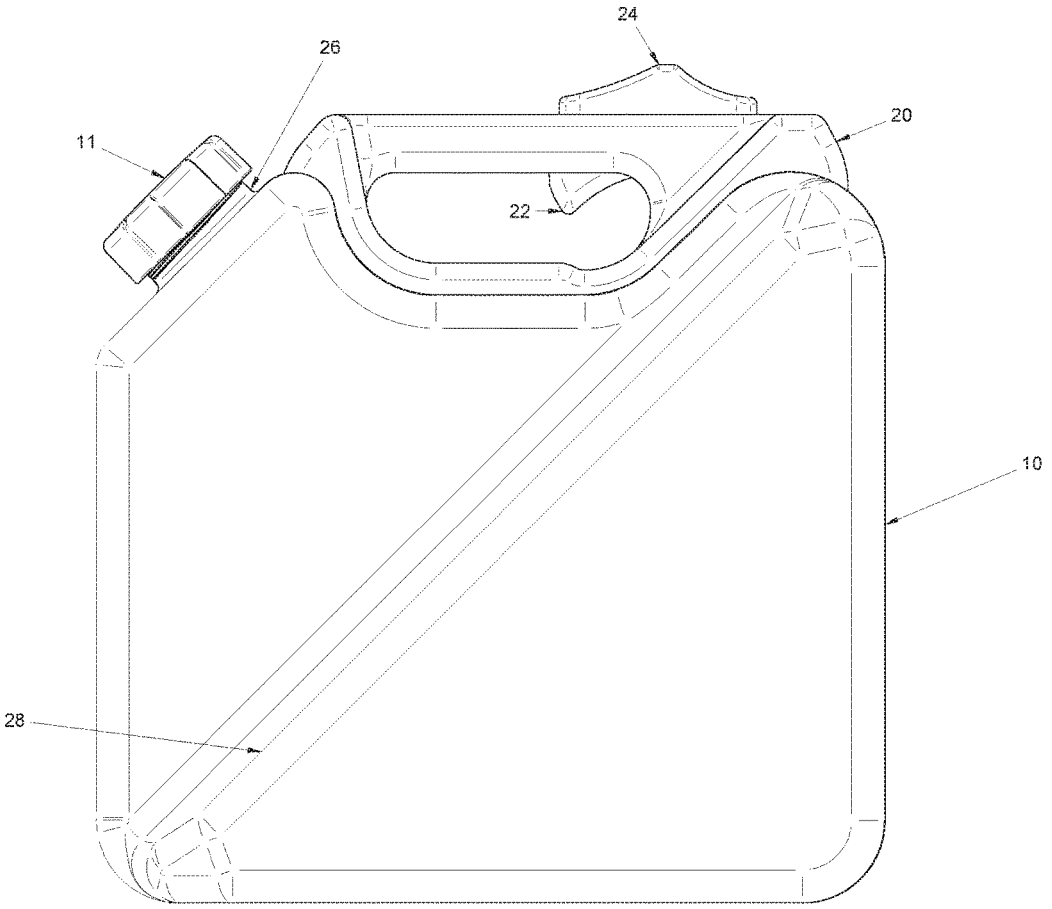
FIG. 2 is a left side view of a PFC.

FIG. 2 is a side view of a PFC. As shown the body 10 has a fill spout 26. The fill spout 26 preferably is sealed with a cap 11. Fill spout 26 is preferably configured to accommodate a standard fuel pump nozzle. Preferably, the fill spout 26 can also mate with a vapor seal of a standard fuel pump. In a preferred embodiment, the cap 11 is attached to the body 10 by a tether (not shown).

The body 10 has a diagonal step 28. The diagonal step 28 allows multiple PFCs to be stacked vertically on their sides in a nesting configuration. According to one aspect of the invention both sides of the body 10 have complementary stacking features. For example, instead of or addition to the diagonal step 28, the body 10 can include complementary mating portions that extend from or are depressed into the body 10. Alternatively, the body 10 can have indents into which a plug can be inserted to mate and stack multiple PFCs.

Figure 3:
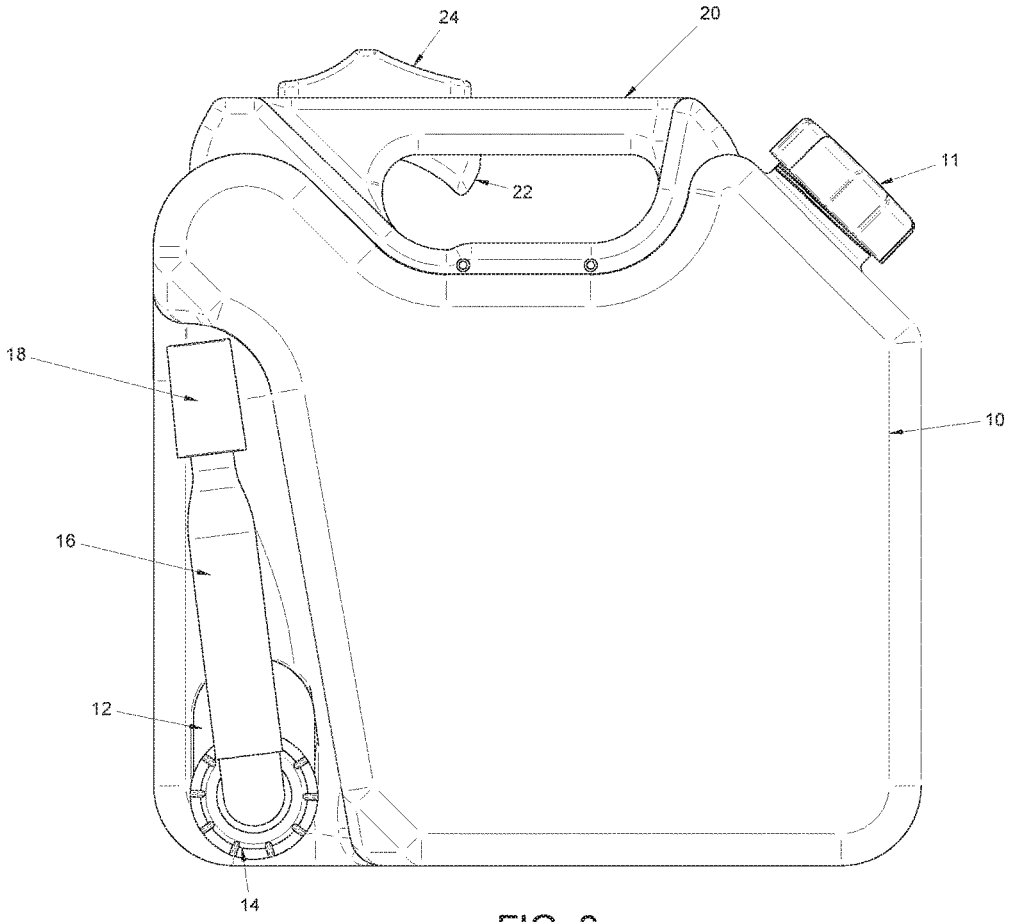
FIG. 3 is a right side view of a PFC.

FIG. 3 is a right side view of the PFC. The body 10 has a cavity in which the spout 16 is stowed in its unused position. As shown, the recess or cavity is substantially L-shaped in horizontal cross section so that the spout can be seen from at least one side of the PFC. The L-shaped cavity eases assembly because spout plate 12 is readily accessible.

In one embodiment, the cavity is substantially U-shaped in horizontal cross section so that the spout is shielded on both sides by portions of the housing.

Figure 4:
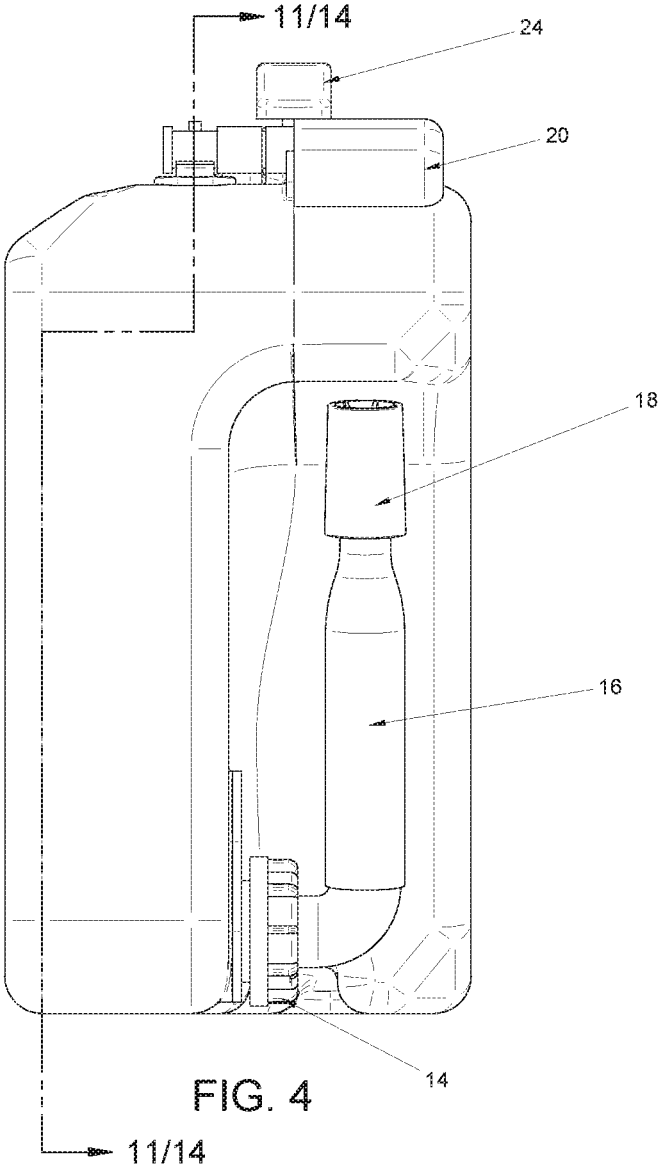
FIG. 4 is a front view of the PFC.
Figure 5:
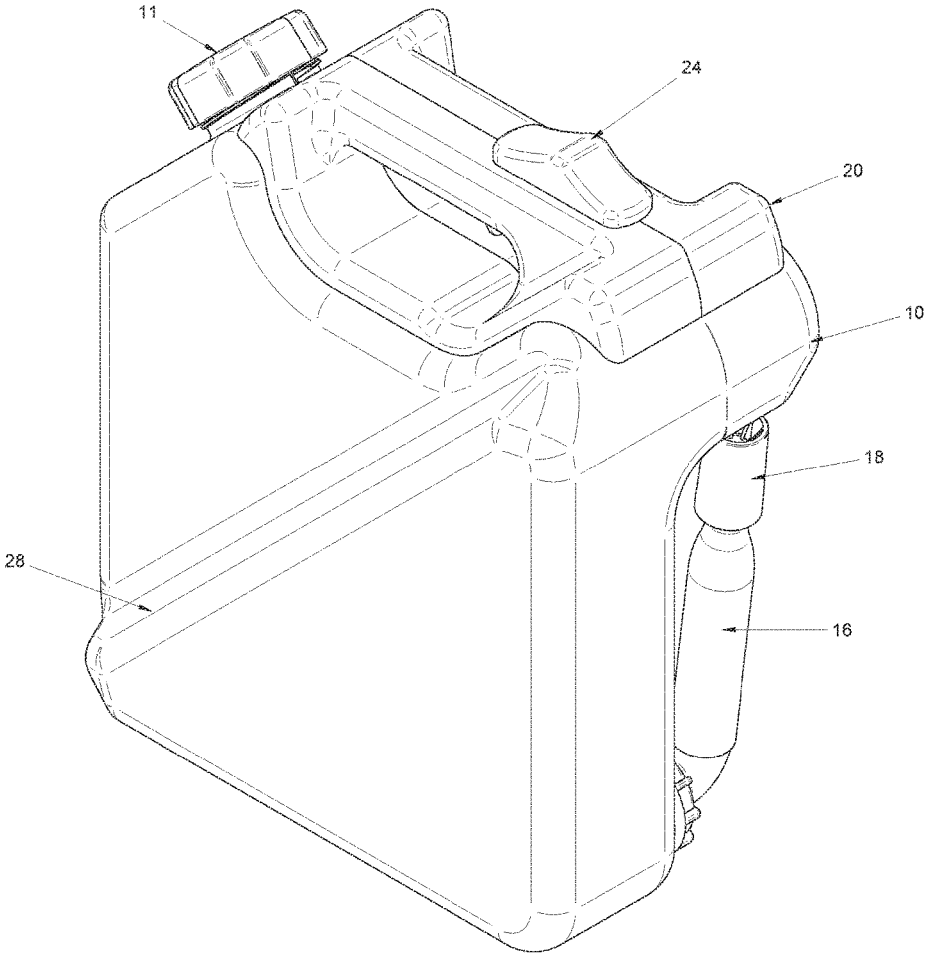
FIG. 5 is a front perspective view of a PFC.
Figure 6:
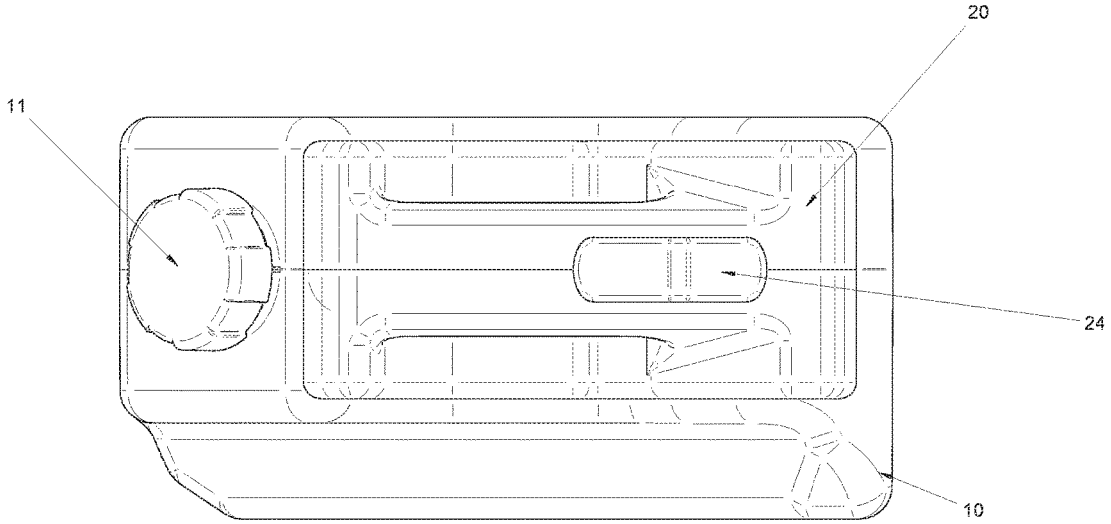
FIG. 6 is a top view of the PFC.

FIG. 4 is a front view of the PFC, FIG. 5 is a front perspective view of a PFC, and FIG. 6 is a top view of the PFC. While the safety 22 is depicted as a trigger and the actuator 24 is depicted as a slide, these components can be reversed or configured in another manner to achieve their stated purpose.

Figure 7:
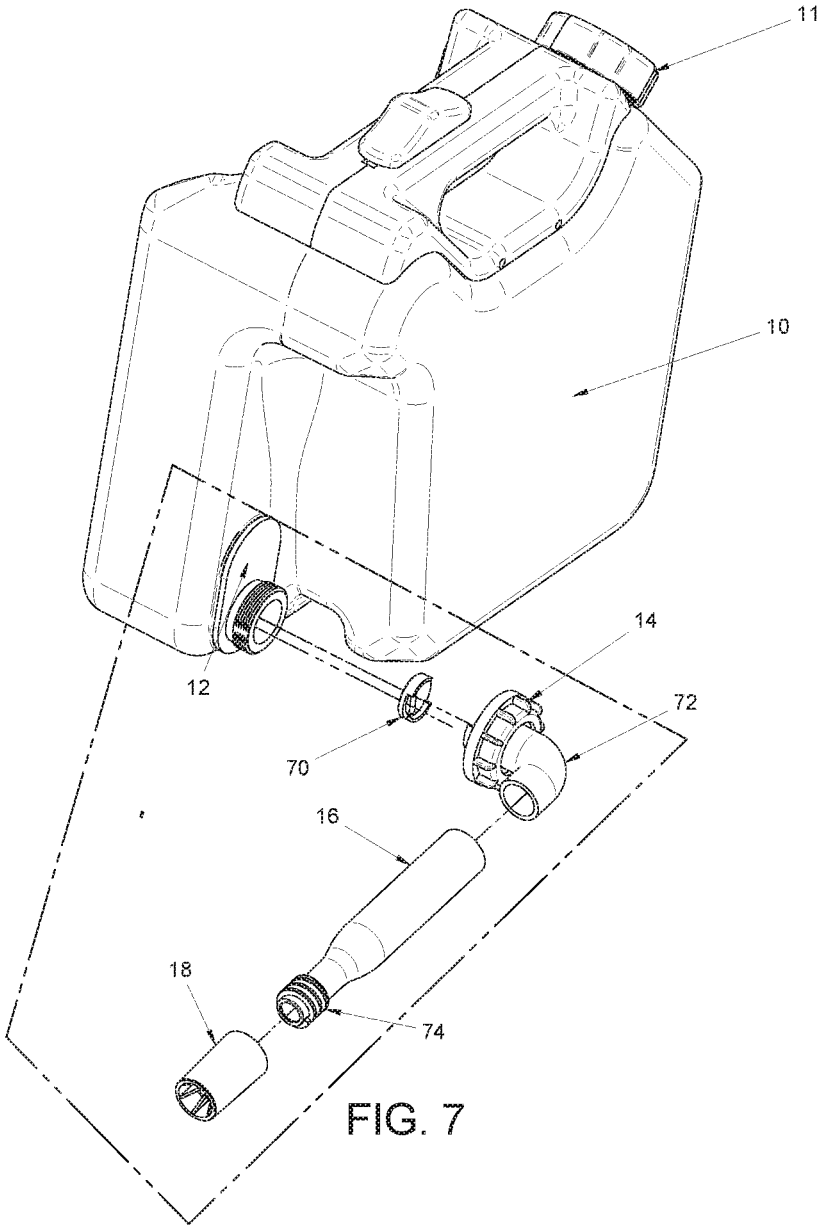
FIG. 7 is a PFC with an exploded view of a spout assembly.
Figure 8:
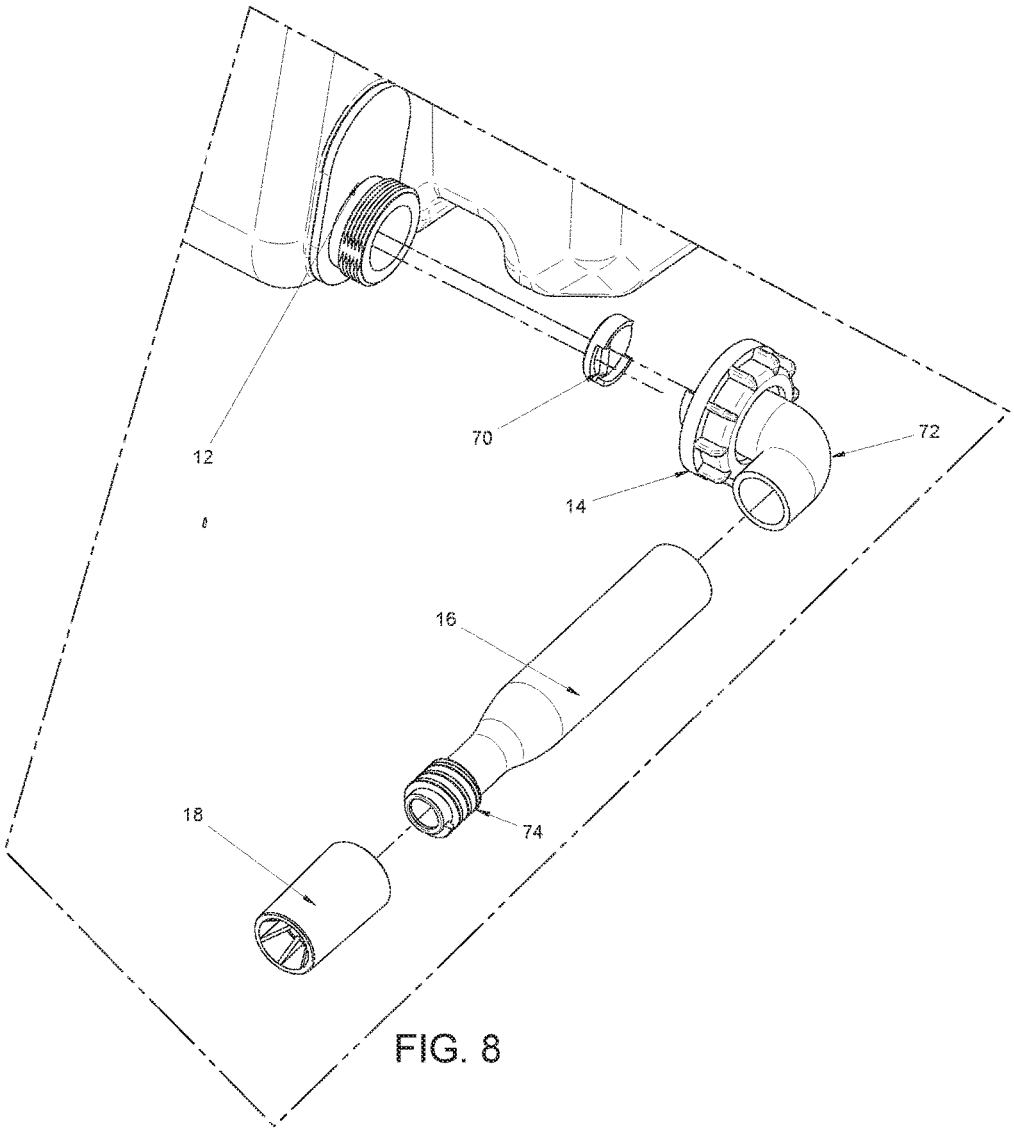
FIG. 8 is an enlarged exploded view of the spout assembly.

FIG. 7 is a PFC with an exploded view of the spout assembly and, FIG. 8 is an enlarged exploded view of the spout assembly. The body 10 has a spout plate 12 by which the spout assembly is attached to the body 10. The spout 16 has a threaded portion 74 at its distal end. The threaded portion is configured to mate with the flow control tip 18, which has a complementary threaded portion on its internal surface. As the flow control tip 18 is threaded onto the spout 16 the flow through the flow control tip 18 is reduced. The flow control tip 18 is permanently affixed to the spout while providing threaded movement thereon to allow for opening of the tip through, for example, counterclockwise rotation, and closing of the tip through, for example, clockwise rotation. The spout 16 is connected to an elbow 72. A diaphragm 70 is attached to the elbow 72. The diaphragm 70 preferably has a half-moon shaped aperture. The diaphragm 70 rotates with the spout assembly from the storage position to the use position. The spout plate 12 has a corresponding half-moon shaped aperture. Maximum flow is achieved when the half-moon aperture in the spout plate 12 is aligned with the half-moon shaped aperture in the diaphragm 70.

In one embodiment, there is an indicator to show a user when the spout assembly is rotated to the maximum flow position. For example, there is an indicator on the spout plate 12 that is aligned with an indicator on the spout 16 or elbow 72. In one embodiment, there is a scale and an indicator to indicate a percentage of flow. In one embodiment, there is a stop to prevent the spout assembly from being rotated beyond the maximum flow position. The spout plate 12 has a threaded coupling. Lock nut 14 threads on to the threaded portion of spout plate 12 to hold the spout assembly in place on the body 10. The elbow 72 preferably has a lip that is sandwiched between the spout plate 12 and the lock nut 14. According to one embodiment of the invention one or more O-rings or other washers are present between the spout plate 12, elbow 72, and lock nut 14.

Figure 9A:
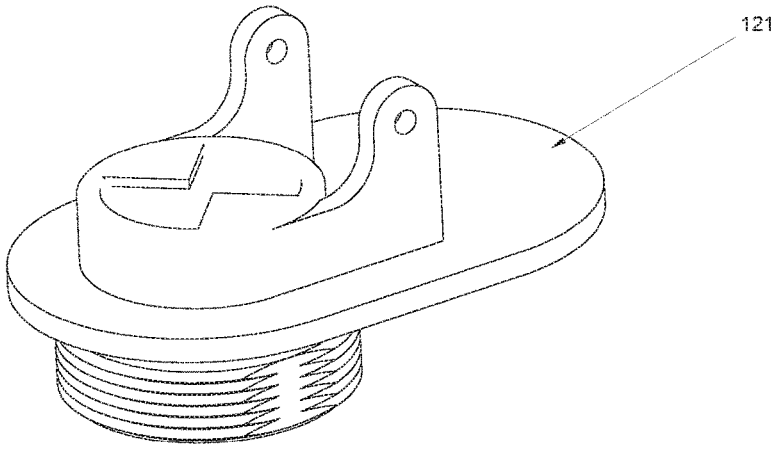
FIGS. 9A and 9B are a spout plate.
Figure 9B:
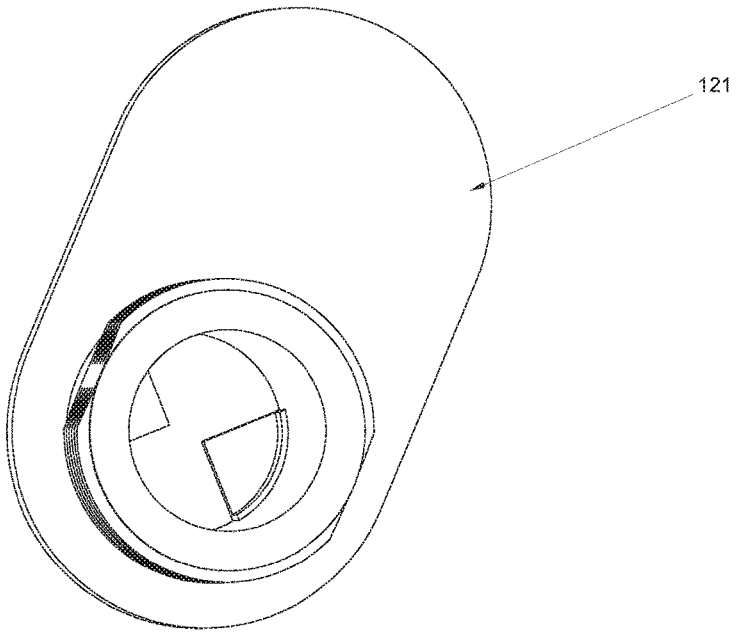

FIGS. 9A and 9B are an alternative spout plate 121. The alternative spout plate 121 has at least one pie slice shaped aperture. The diaphragm in the spout assembly would have one or more corresponding apertures. Alternatively, other shaped apertures can be utilized. It should be noted that the spout plate and the diaphragm do not necessarily have to have matching apertures.

Figure 10A:
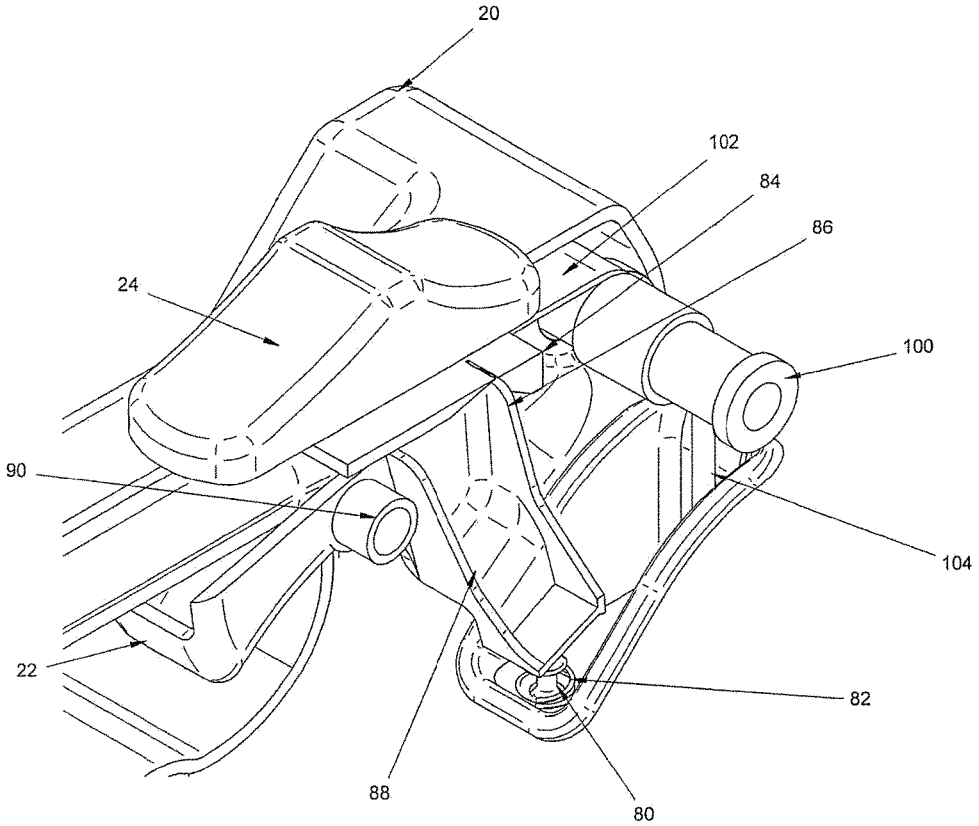
FIGS. 10A and 10B are cut-away views of the handle assembly in an unactuated position.
Figure 10B:
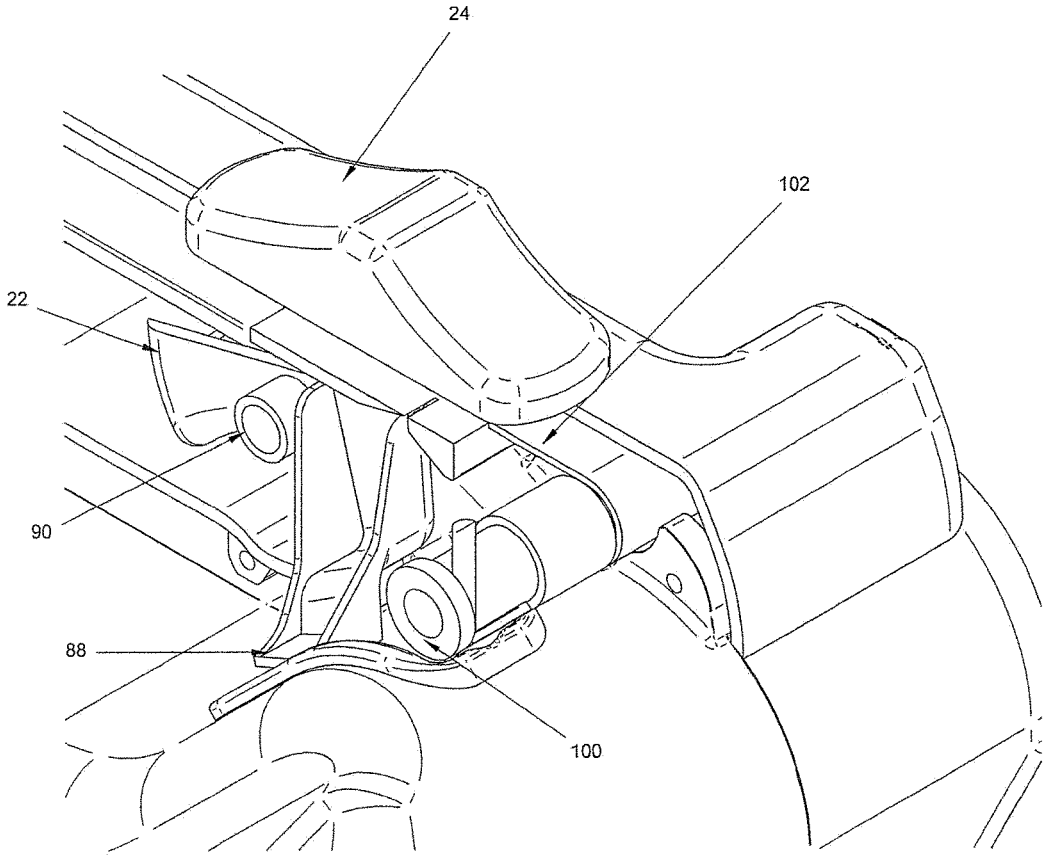

FIGS. 10A and 10B are cut-away views of the handle assembly in an unactuated position. As shown, a portion of the handle 20 has been removed revealing the actuating assembly elements. As shown, the safety 22 has a pivot 90. In an un-actuated position, a trigger safety lock 86 mates with an actuator lock 84 preventing actuator 24 from moving.

A vent actuator portion 88 of the safety 22 is configured to activate vent valve 80. The vent valve 80 is biased in a closed position by a vent bias spring 82. As shown, the vent valve 80 is closed in a vertically upward position. It should be noted that the pivot action of the safety 22 can be reversed so that the vent valve 80 is biased vertically downward in a closed position and the safety 22 opens the valve by lifting the vent valve 80 from a valve seat or alternatively the vent valve 80 can be installed in the body 10 horizontally. The actuator 24 acts on a horizontal actuator arm 102. The horizontal actuator arm 102 is coupled to an actuator axle 100. A vertical actuator arm 104 is also coupled to the actuator axle 100.

Figure 11:
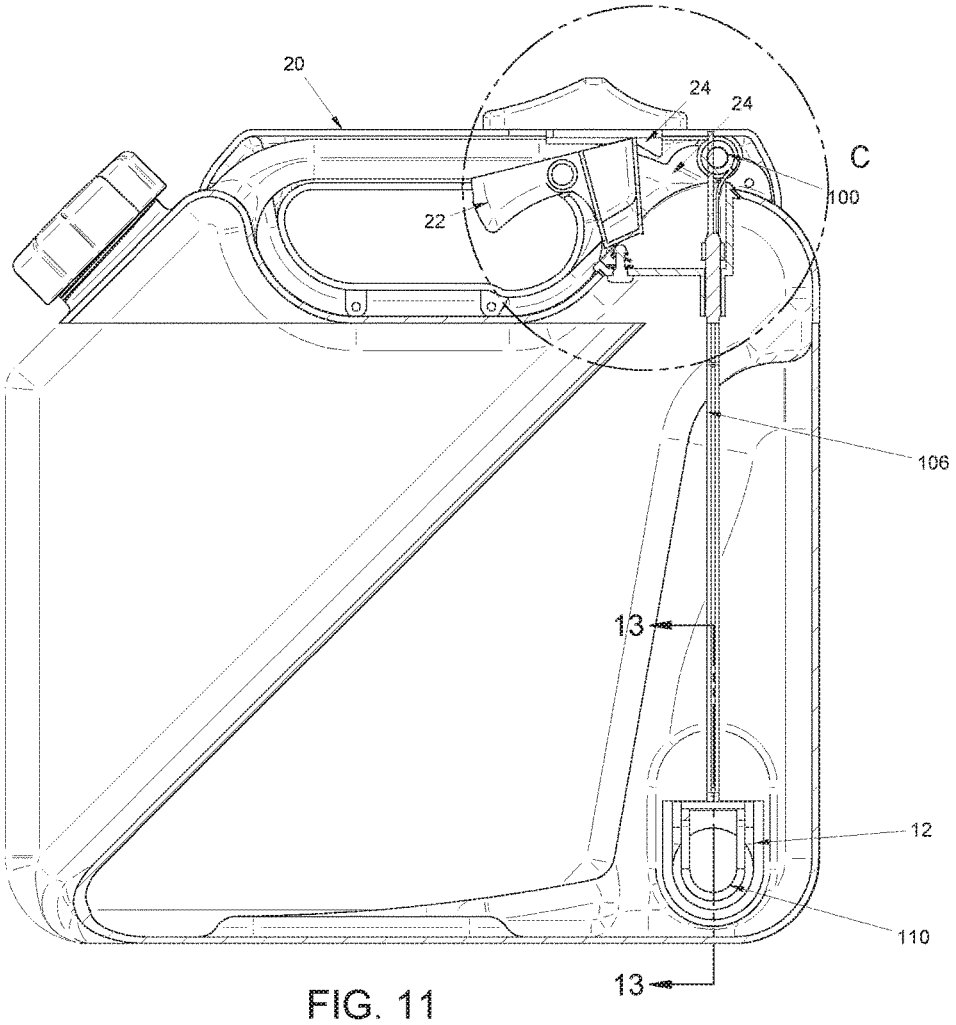
FIG. 11 is a cross section of the PFC in an unactuated position.

FIG. 11 is a cross section of the PFC in an unactuated position along the line 11-11 shown in FIG. 4. As will be discussed in more detail below, the actuator 24 is coupled to and controls valve 110. Actuator 24 is coupled to actuator bar 106 by a translating element that converts a linear horizontal sliding motion to a vertical motion to open valve 110.

Figure 12:
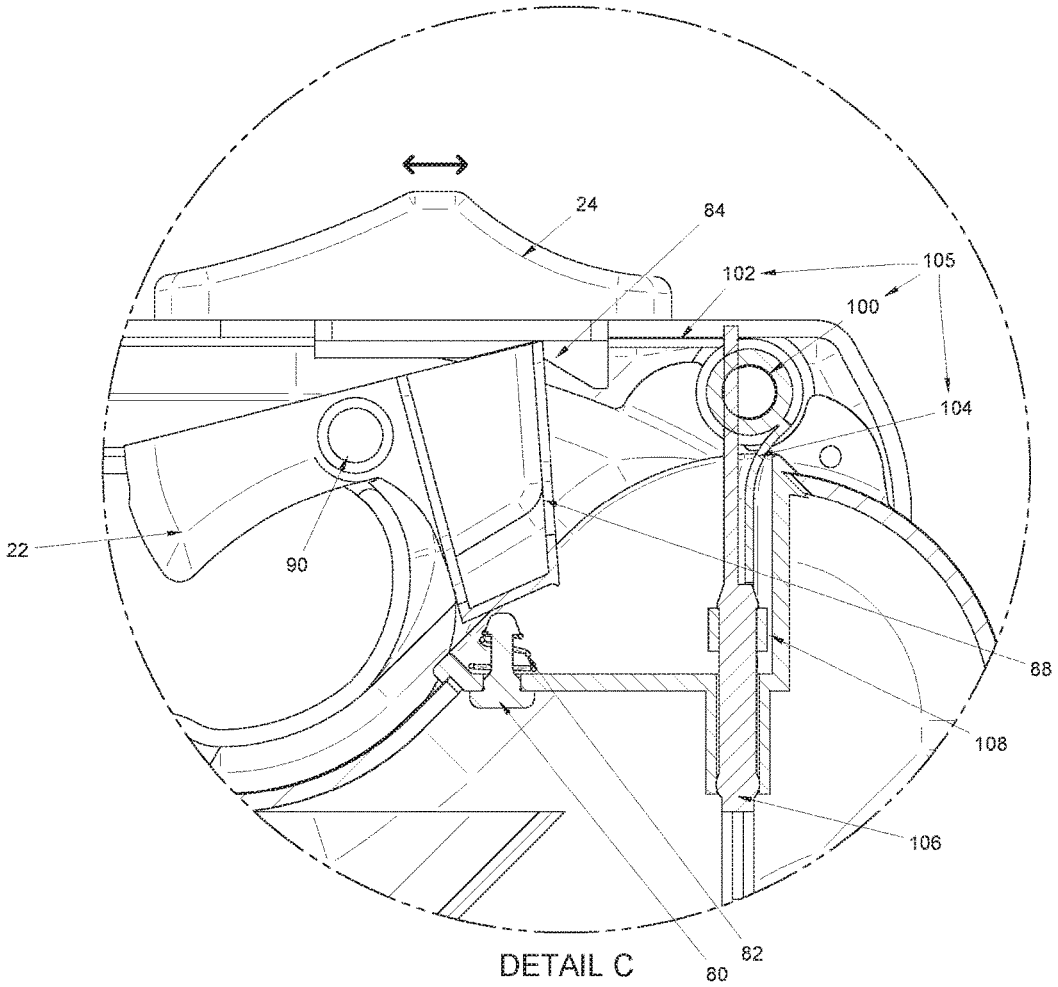
FIG. 12 is detail C in FIG. 11.

FIG. 12 is detail C in FIG. 11. As shown, the actuator 24 is configured to slide horizontally. Actuator 24 is prevented from moving by the actuator lock 84. When the safety 22 is engaged, actuator lock 84 prevents actuator 24 from moving. As shown, the safety mates with the actuator to prevent motion. While shown as an angled indent, other locking mechanisms can used including pins and holes, bars and slots, and the like.

The actuator 24 is coupled to horizontal actuator arm 102, which is coupled to the actuator axle 100. The actuator axle 100 is coupled to vertical actuator arm 104. In one embodiment, actuator axle 100, horizontal actuator arm 102 and vertical actuator arm 104 are formed as a single element by molding. This translation element 105, whether a single piece or multiple elements, provides the translation of the horizontal movement of actuator 24 to the vertical movement of actuator bar 106. In a preferred embodiment the actuator axle 100, horizontal actuator arm 102, and vertical actuator arm 104 are a single molded plastic component molded from high density polyethylene, propylene, or the like. Alternatively, the horizontal actuator arm 102 and vertical actuator arm 104 can be formed from spring steel or the like and attached to the actuator axle 100. The horizontal actuator arm 102 and vertical actuator arm 104 provide biasing to maintain valve 110 in its closed position. Alternatively, or in addition to the biasing provided by the horizontal and vertical arms, a biasing element such as a spring can be used.

Vertical actuator arm 104 includes a coupler 108. The coupler 108 couples the actuator bar 106 to the actuator 24. As the horizontal actuator arm 102 is unwound from the actuator axle 100 by horizontal movement of the actuator 24, shown by the double-headed arrow, the vertical actuator arm 104 is wound about actuator axle 100. Likewise, when horizontal actuator arm 102 is warrant on to actuator axle 100 by releasing of the actuator 24, the vertical actuator arm 104 is unwound from actuator axle 100.

The vent valve 80 is actuated by vent actuator portion 88, which is part of the safety 22. The vent valve 80 can be actuated to relieve pressure inside the body 10 without actuating the actuator 24 by simply pulling up on safety 22.

Figure 13:
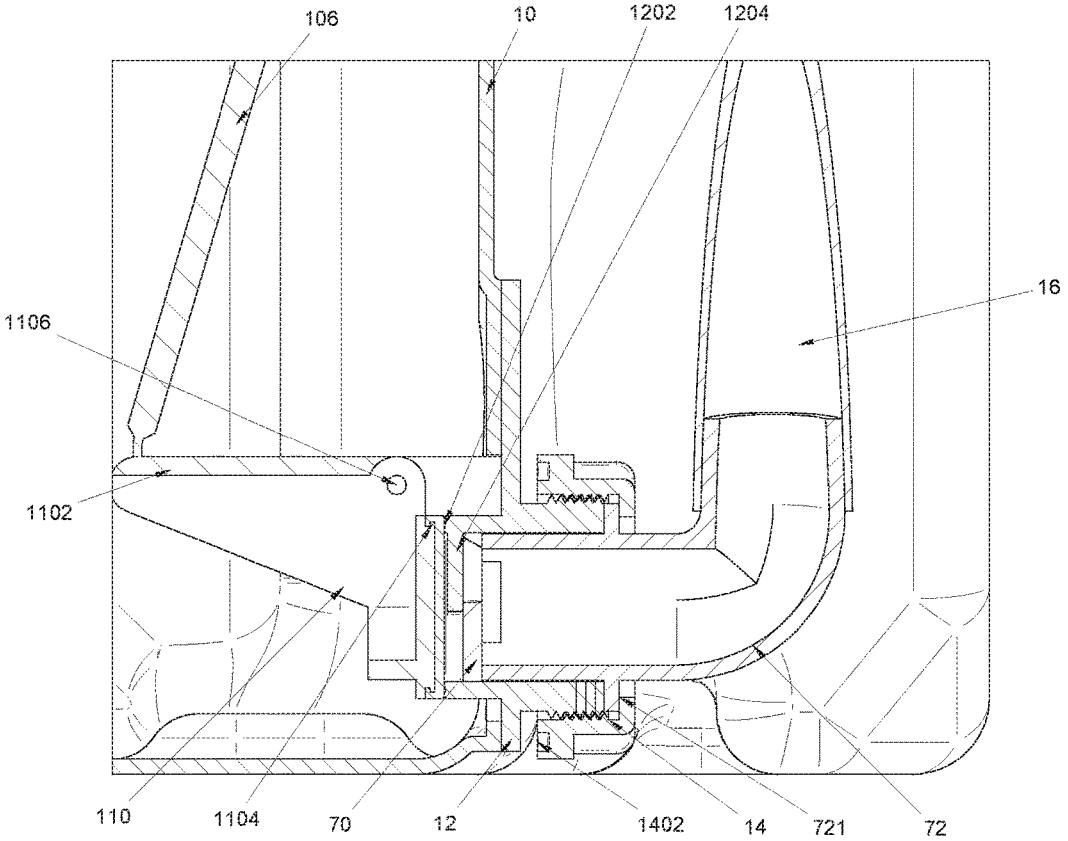
FIG. 13 is a cross section of the spout in an unactuated position.

FIG. 13 is a cross section along line 13-13 of the spout assembly and valve 110 in an unactuated position. As shown, a gasket 1104 of the valve 110 is proximate to seat 1202 of spout plate 12 preventing fluid from entering the spout assembly. The actuator bar 106 is attached to lever arm 1102. As actuator bar 106 moves vertically, valve 110 pivots about pivot axle 1106 to open the valve 110. A wall 1204 of the spout plate is aligned with an aperture in the diaphragm 70. Similarly, an aperture in the wall 1204 of the spout plate is aligned with a wall of the diaphragm 70. In this manner, fluid flow is prevented through the spout plate and diaphragm 70 when the spout assembly is in its storage position. In a preferred embodiment, the gasket 1104 is a fuel resistant rubber. The elbow 72 has a lip 721 that is sandwiched between the spout plate 12 and the lock nut 14. According to one embodiment of the invention one or more O-rings 1402 or other washers are present between the spout plate 12 and lock nut 14.

To move the spout assembly from the storage position to the use position, the lock nut 14 is loosened. Once the lock nut 14 is loosened the spout assembly can be rotated into its use position (see FIG. 16). The lock nut 14 is then tightened to prevent movement of the spout assembly once it is moved into its use position.

Figure 14:
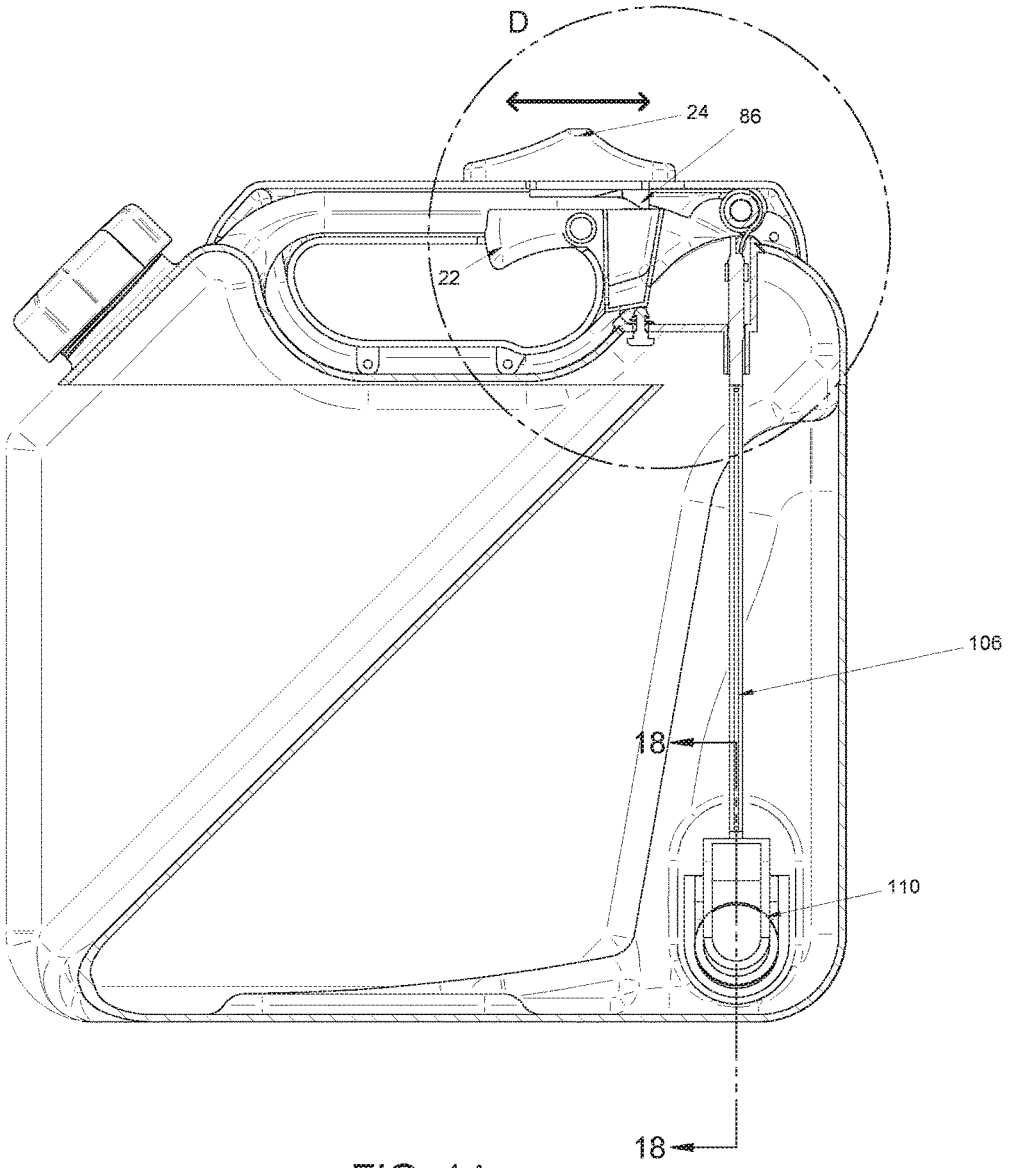
FIG. 14 is a cross section of the PFC in an actuated position.

FIG. 14 is a cross section of the PFC in an actuated position along the line 14-14 in FIG. 4. As shown, the safety 22 is pivoted upward thereby releasing trigger safety lock 86. The actuator 24 has been moved horizontally toward cap 11, thereby moving the actuator bar 106 vertically and opening valve 110. It should be noted that if the spout assembly is not moved into its use position no fluid will flow, even if the actuator 24 is activated.

Figure 15:
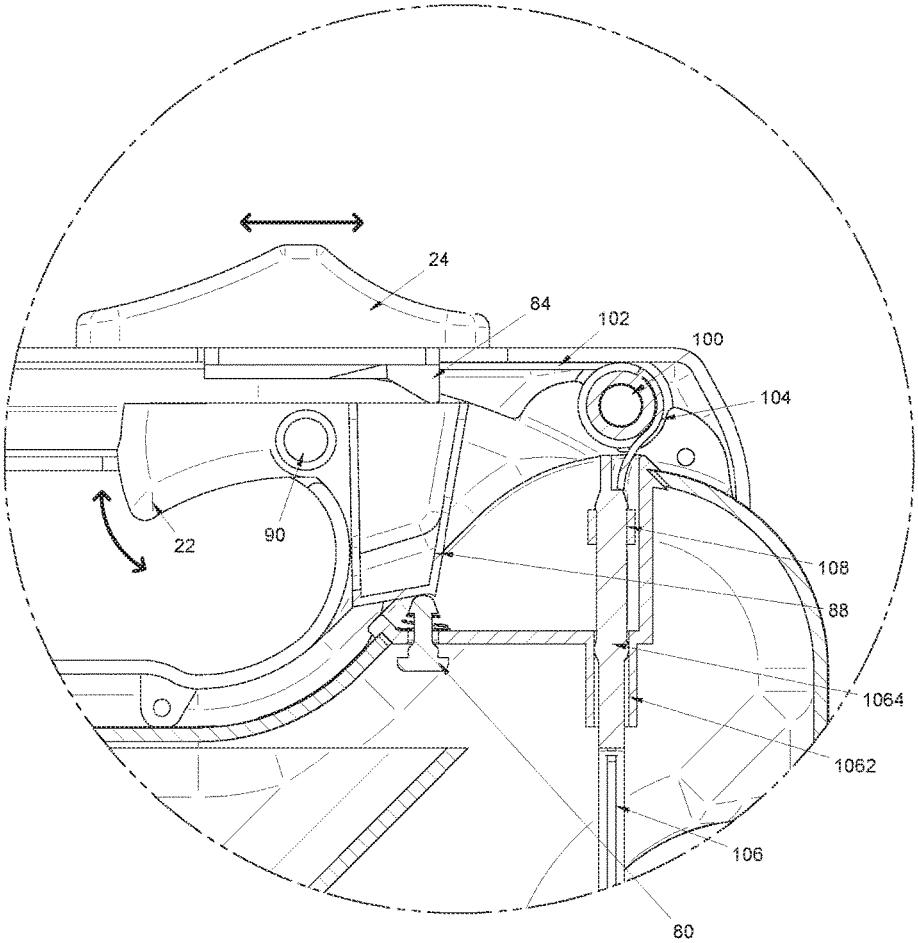
FIG. 15 is detail D in FIG. 14.

FIG. 15 is detail D shown in FIG. 14. As shown in FIG. 15, the actuator 24 has been moved horizontally into its activated position toward cap 11. Additionally, the safety 22 is moved into its disabled position, which allows the actuator 24 to be moved. The vent actuator portion 88 has opened the vent valve 80 allowing the PFC to vent.

Compared to FIG. 12, the horizontal actuator arm 102 is unwound from the actuator axle 100 and the vertical actuator arm 104 is wound upon actuator axle 100. The vertical actuator arm 104 and horizontal actuator arm 102 are axially offset from one another along actuator axle 100. Alternatively, one of the arms can be split into two separate portions and the other arm can be arranged between the two portions. The diameter of actuator axle 100 is configured such that approximately ½ inch of movement of the actuator 24 results in approximately 180° of rotation of the actuator axle 100. The actuator bar 106 is guided by a sleeve 1062. In one embodiment of the invention, the actuator bar 106 is sealed in the sleeve 1062 by a seal 1064, configured as an O-ring. The sleeve 1062 is preferably long enough to accommodate the travel of actuator bar 106 so that the seal 1064 travels within the sleeve 1062 preventing leakage through the sleeve 1062.

As is evident from FIG. 15, when the safety 22 is pivoted about pivot 90 the vent valve 80 is opened. The vent valve 80 can be opened without actuator 24 being moved horizontally, although the actuator 24 is unlocked and able to move. In this manner, the PFC can be vented before filling the PFC and/or used to fill another container.

Figure 16:
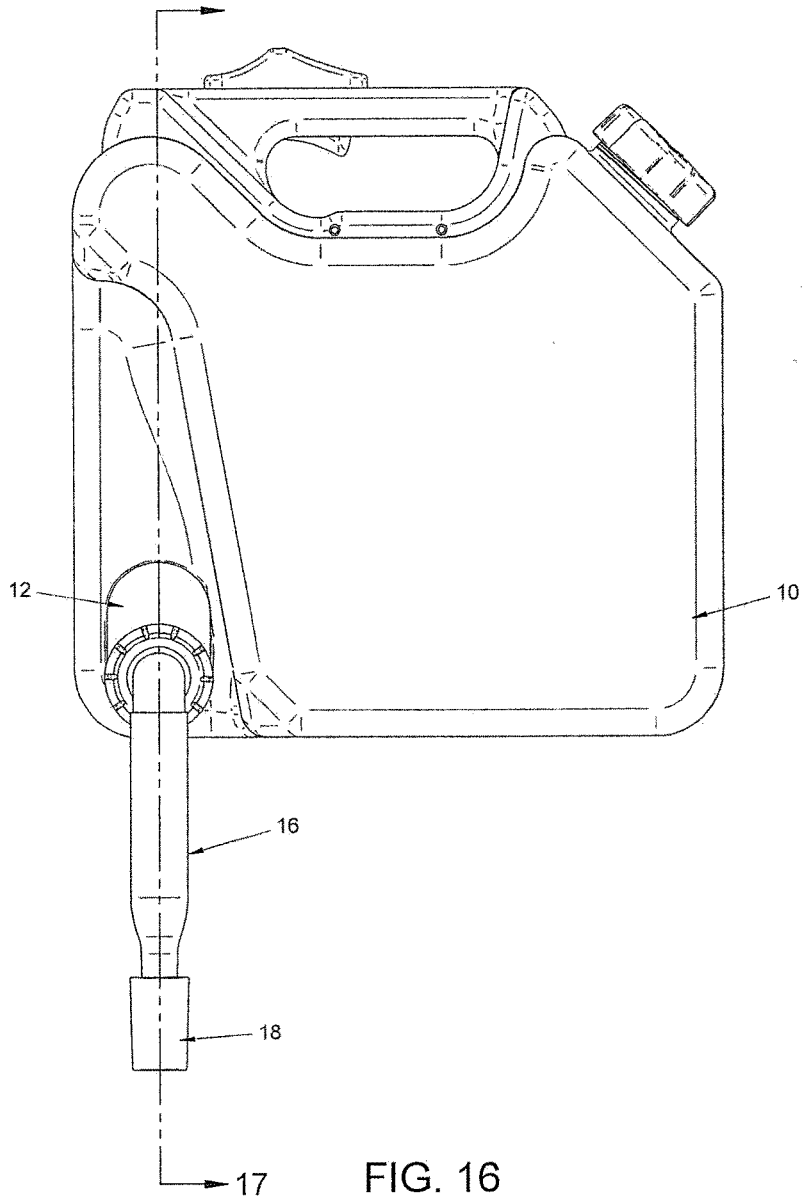
FIG. 16 is a right side view of a PFC with the spout in a use position.

FIG. 16 is a right side view of a PFC with the spout assembly in a use position. While the spout assembly is shown rotated by 180°, the use position can be designed to be angled. In one embodiment, the use position is approximately 135° from the stored vertical position. At the use position the half-moon openings in the spout plate 12 and diaphragm 70 are aligned. In one embodiment, the half-moon opening in the spout plate 12 can be adjusted by the user so that the maximum flow position (the angular position the spout assembly makes with the vertical) is adjusted.

Figure 17:
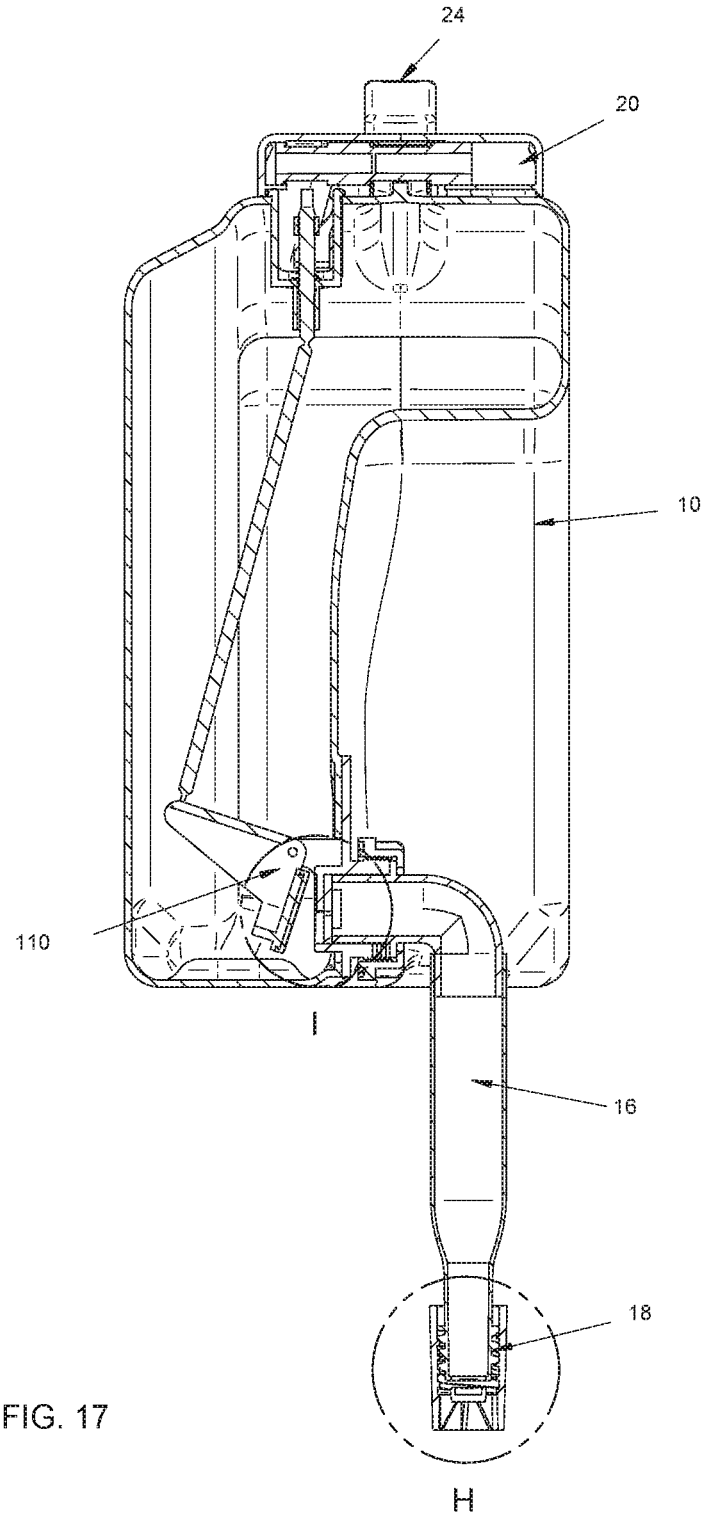
FIG. 17 is a cross section of the PFC in an actuated position
Figure 18:
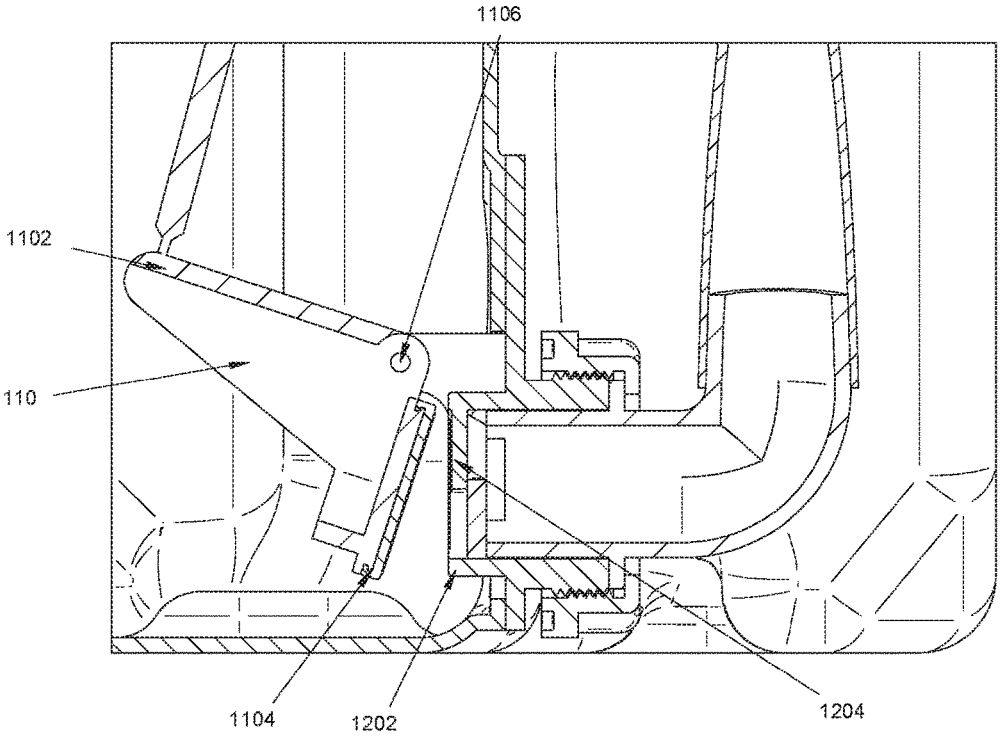
FIG. 18 is a cross section of the spout in an open position.

FIG. 17 is a cross section of the PFC in an actuated position along the line 17-17 of FIG. 16. As shown, the valve 110 is open so that fluid can flow through the spout 16. FIG. 18 is a cross section of the valve 110 in an actuated open position. In FIG. 18, while the valve 110 is open, the spout assembly is still in the storage position. As such, the openings in the spout plate 12 and the diaphragm 70 are not aligned and liquid cannot flow. In the open position the valve pivots about pivot 90 so that the gasket 1104 is no longer in contact with seat 1202. The translation element 105 biases the valve 110 closed. According to one aspect of the invention, an additional biasing element is present biasing the valve 110 closed.

Figure 19:
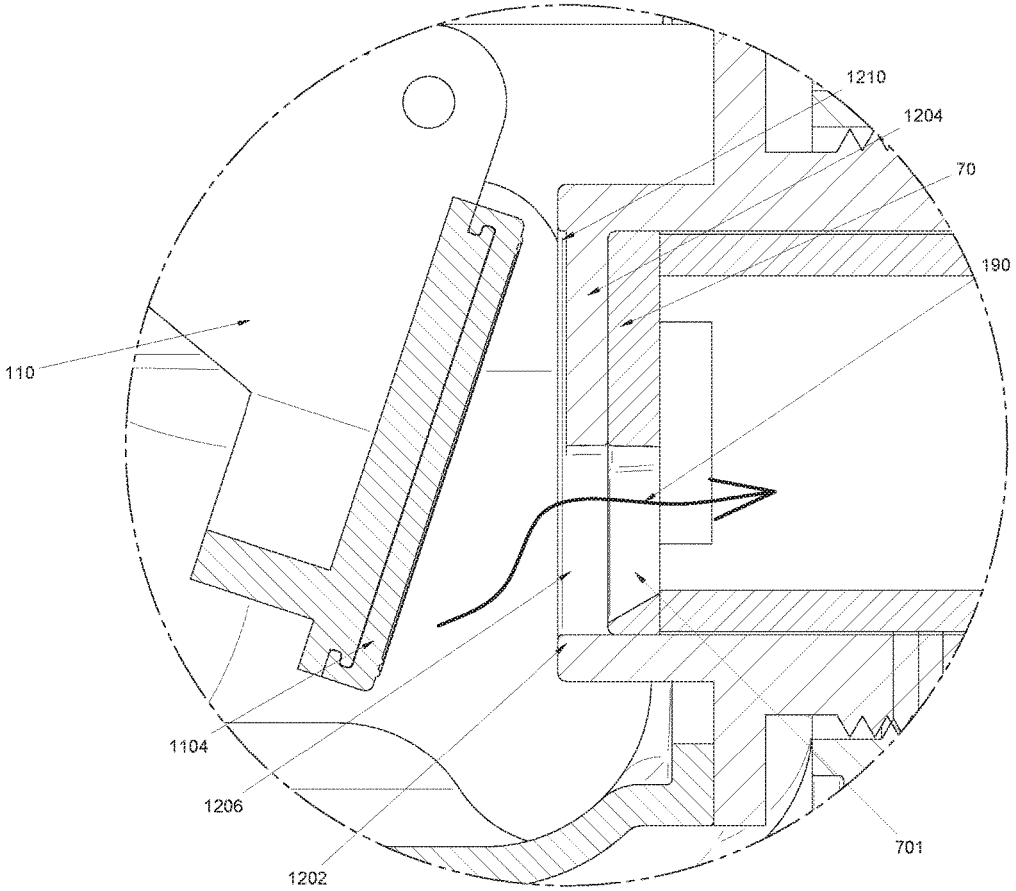
FIG. 19 is detail I in FIG. 17.

FIG. 19 is detail I shown in FIG. 17. Arrow 190 represents fluid flow through the valve 110 and spout assembly. When the valve 110 is open gasket 1104 does not seal the opening in spout plate 12. Because the spout assembly is rotated into its use position, aperture 1206 in the spout plate 12 is aligned with aperture 701 in the diaphragm 70. According to one embodiment of the invention, an additional spout diaphragm 1210 is provided across the inner face of the spout plate 12 that mates with the gasket 1104. The additional spout diaphragm 1210 allows fluid to flow when the valve 110 is open and the apertures 1206 and 701 are aligned.

According to one embodiment of the invention the valve 110 slides instead of pivots. In this embodiment, as the activator is engaged, instead of pivoting about pivot 1106, the face of the valve 110 and the gasket 1104 move parallel to the seat 1202 in a sliding motion by sliding in tracks to open the valve.

According to one embodiment, the diaphragm 70 has a locking mechanism configured to mate with a protrusion extending from the valve 110 towards the diaphragm 70. The locking mechanism is configured to prevent the valve 110 from opening when the spout assembly is in the storage position. For example, the valve can have an L-shaped hook and the diaphragm 70 can have a U-shaped piece into which the L-shaped hook can be inserted. Other locking mechanisms can be used. As the diaphragm 70 is rotated by the spout assembly being moved into the storage position, the complementary locking portions of the valve 110 and the diaphragm 70 mate so that the valve cannot open. If this secondary lock is present, the valve 110 cannot open, even if the safety is released.

In a preferred embodiment, the spout assembly is arranged at a lower edge of the body 10 so that the apertures 701 and 1206 are proximate to a bottom of the body 10. In this manner, a maximum amount of liquid can be removed from the PFC. In one embodiment a channel is provided in a base of the body 10 to guide the liquid in the PFC to the spout assembly an particularly to the apertures 701 and 1206.

In one embodiment of the invention the spout assembly includes a filter to filter particulate matter. In one embodiment of the invention the fill spout 26 includes a filter to filter particulate matter. The filter can be a screen, mesh, woven fiber, or the like.

Figure 20:
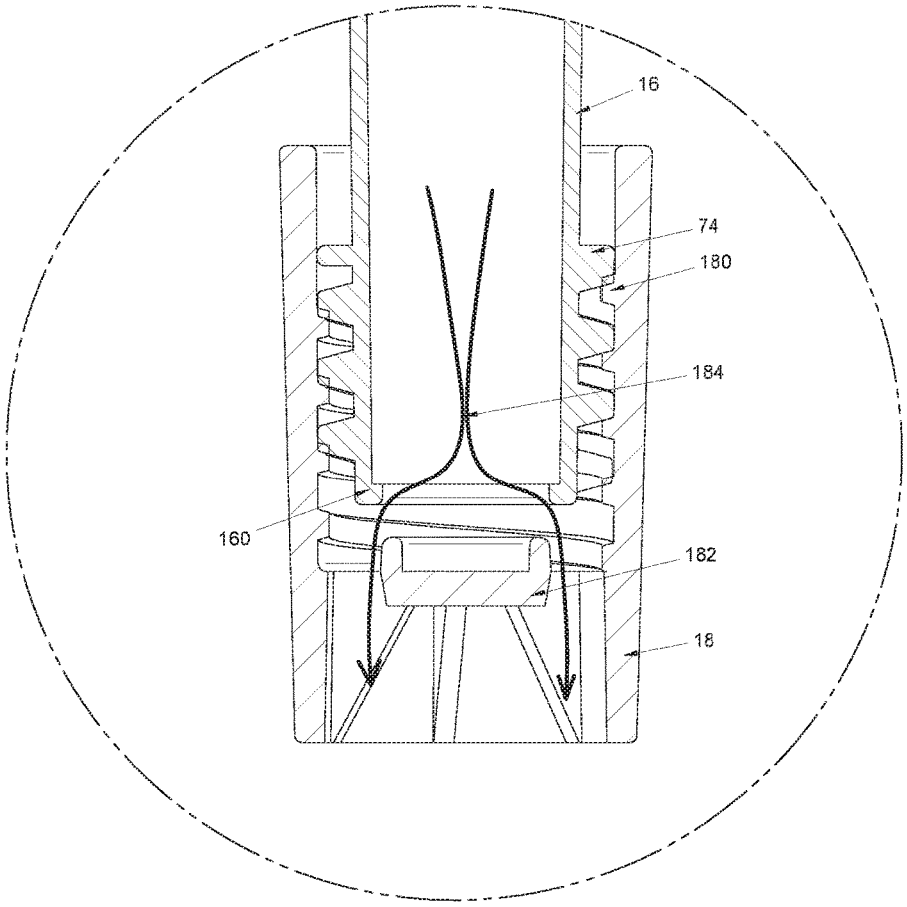
FIG. 20 is detail H in FIG. 17.

FIG. 20 is detail H of the flow control tip 18 shown in FIG. 17. As shown, the flow control tip 18 is threaded onto the threaded portion 74 of the spout 16 via internal threads 180. The flow control tip 18 has a gate 182 configured to mate with seat 160 of the spout 16. As the flow control tip 18 is rotated the flow 184 increases or decreases as the space between the gate 182 and seat 160 increases or decreases.

In one embodiment the only time that any liquid can exit the PFC is when the safety 22 is deactivated, the actuator 24 is moved horizontally, the spout assembly is rotated into its use position, and the flow control tip 18 is opened. This provides a PFC that, without user error, is substantially spill proof.

According to one aspect of the invention, the fluid container has a body 10, a handle 20 arranged in a top section of the body 10, a flow trigger 24 in the handle 20, and a safety trigger 22 that interacts with the flow trigger and prevents activation of the flow trigger. A vent assembly 80, 82 is arranged in the body 10 and is configured to be activated by the safety trigger 22 to vent the body 10. A spout 16 is movably coupled to the body 10 and rotates between a use position and a storage position. A first valve 70, 701, 1204, 1206 opens as the spout 16 is moved from the storage position to the use position. A second valve 110 is arranged upstream of the first valve in a flow direction 190, which controls fluid flow into the spout 16. A linkage mechanism 106 is arranged between the flow trigger 24 and the second valve 110. Linkage mechanism 106 opens the second valve 110 when the flow trigger 24 is activated and the safety trigger 22 is released.

Figure 21A:
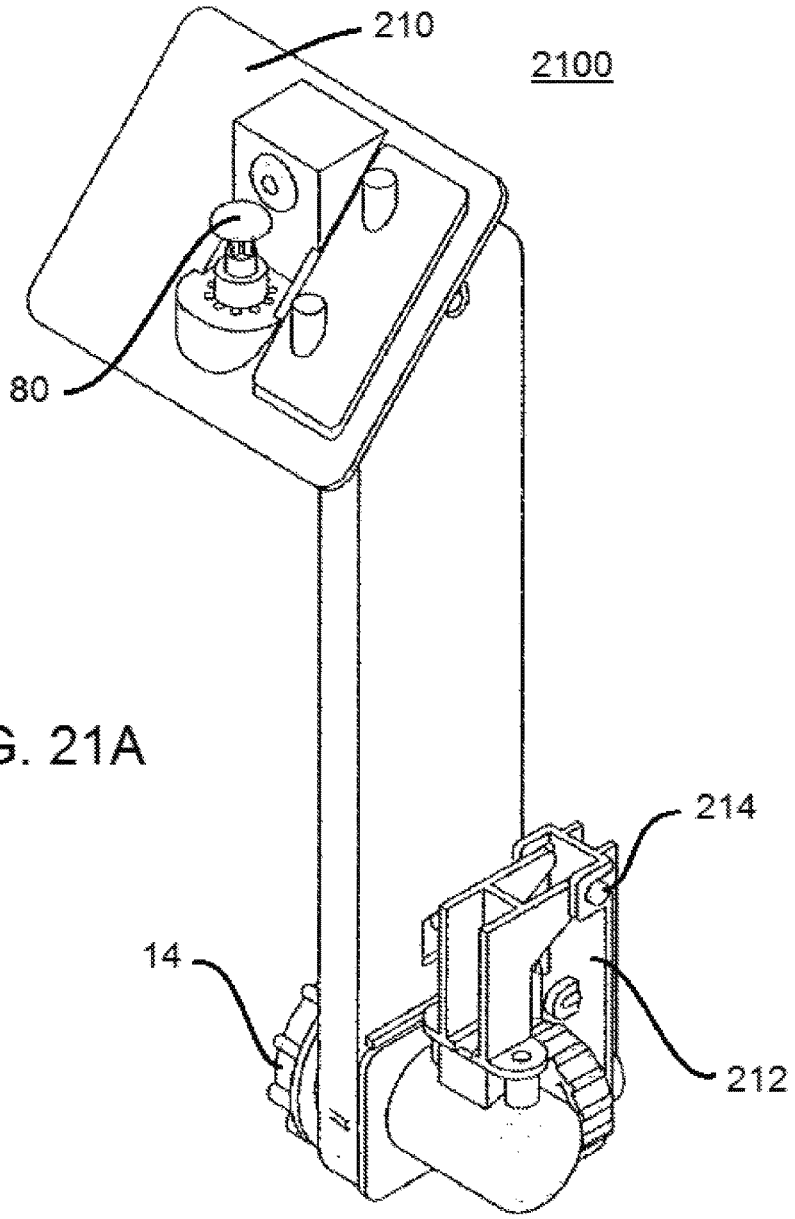
FIG. 21A is a valve assembly for a PFC.
Figure 21B:
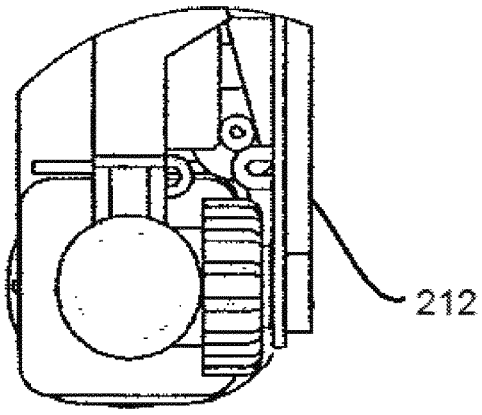
FIG. 21B is a closed valve.
Figure 21C:
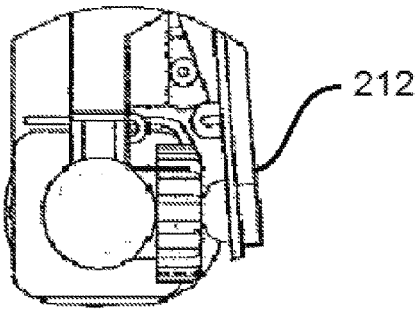
FIG. 21C is an open valve.

FIG. 21A is an alternative style valve assembly for a PFC. The valve assembly 2100 is assembled prior to installing it in body 10. The valve assembly 2100 has a flap 212 that pivots about a pivot point 214. When an actuator (not shown) is activated, the flap 212 is moved from a closed position to an open position. A lock nut 14 is shown in FIG. 21A. The lock nut 14 would typically not be present on the assembly when it is being inserted into the PFC. FIG. 21B is a closed valve and FIG. 21C is an open valve. Specifically, in FIG. 21B the flap 212 is seated and in FIG. 21C the flap is unseated.

Figure 21D:
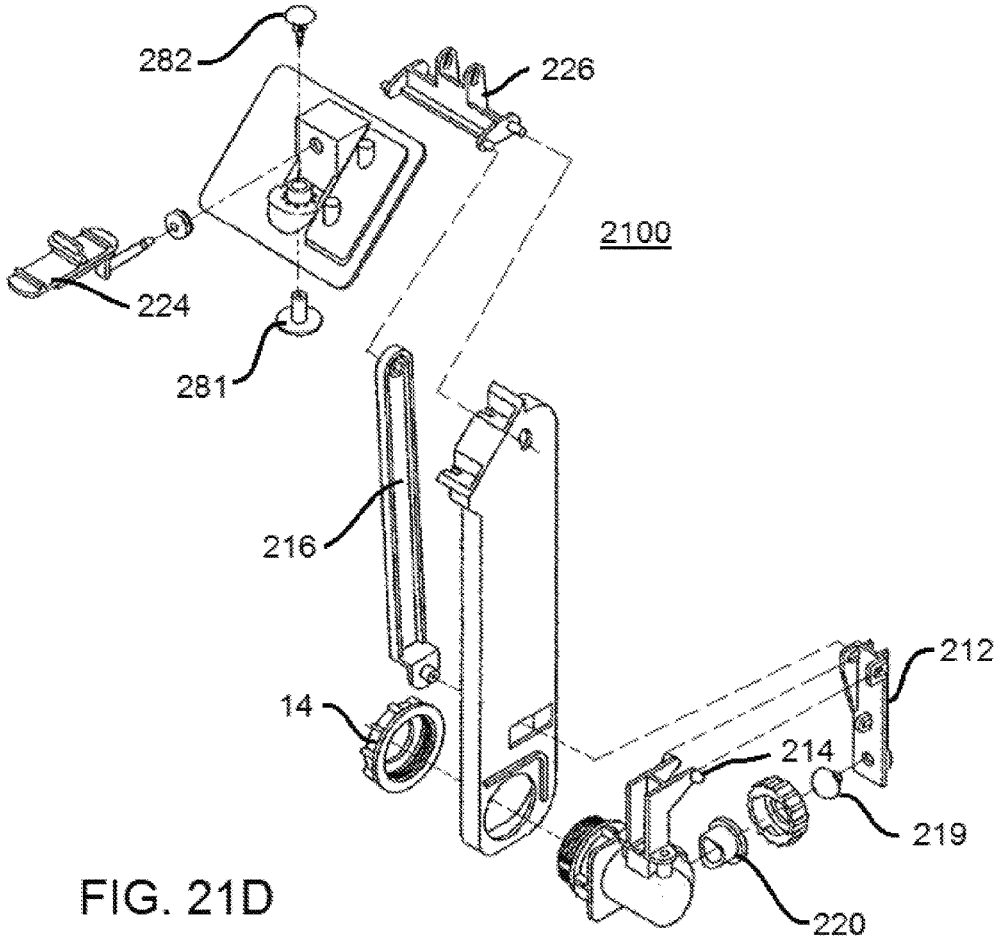
FIG. 21D is an exploded view of the valve assembly of FIG. 21A.

FIG. 21D is an exploded view of the valve assembly of FIG. 21A. Valve assembly 2100 includes an actuator 224 that acts on a pivot assembly 226. The pivot assembly 226 moves connector 216 so that the flap 212 can pivot from a closed to an open position. The flap 212 has a seal element 219 that seats in a seat 220.

According to one aspect of the invention, the fluid container comprises:

a body 10 including a pair of opposite sidewall regions; a front wall connecting the pair of opposite sidewall regions; a rear wall connecting the pair of opposite sidewall regions; a top section comprising a sealable opening; and a base section opposite the top section;

a handle 20 arranged in the top section and including a flow trigger 24; and a safety trigger 22 configured to interact with the flow trigger 24 and prevent activation of the flow trigger 24;

a vent assembly 80, 82 configured to be activated by the safety trigger 22 and vent the body 10;

a spout 16 movably coupled to the body 10 and configured to rotate between a use position and a storage position, the spout 16 including a tubular portion; a lock mechanism 14 configured to couple the spout 16 to the body 10; and a first valve 70, 701, 1204, 1206, 1210 configured to open from a closed position, when the spout 16 assembly is in the storage position, to an open position as the spout 16 assembly is moved from the storage position to the use position, wherein fluid flow 190 is prevented by at least a first valve when the spout 16 is in the storage position;

a second valve arranged upstream of the first valve in a flow direction 190 to control fluid flow into the spout 16; and a linkage mechanism 106, 116 coupled between the flow trigger 24 and the second valve 110, 212 and configured to open the second valve 110, 212 when the flow trigger 24 is activated and the safety trigger 22 is released. According to one aspect of the invention, the linkage mechanism 106 includes an axle 100 configured to rotate about its longitudinal axis, a horizontally extending arm 102 having a first end coupled to the axle 100 and a second end coupled to the flow trigger 24, and a vertically extending arm 104 having a first end coupled to the axle 100 and a second end coupled to the second valve 110. Preferably, the horizontally extending arm 102 and the vertically extending arm 104 are longitudinally offset from one another along the axle and the horizontal movement of the horizontally extending arm 102 is translated into vertical movement of the vertically extending arm 104. Alternatively, linkage mechanism 226 is used.

According to one aspect of the invention, the flow trigger 24 is movably coupled to the handle 20 and the safety trigger 22 is configured to engage with the flow trigger 24 to prevent movement of the flow trigger 24. The flow trigger 24 is slidably coupled to the handle 20 and the safety trigger 22 is pivotably couple to the handle 20 and configured to engage with the flow trigger 24 to prevent sliding movement of the flow trigger 24.

According to one aspect of the invention, the first valve comprises a first gating component 70 defining a flow aperture 701 and a second gating component 1204 defining a flow aperture 1206. The first valve is configured to rotate with the spout 16. When the spout 16 is in the storage position the flow aperture 701 in the first gating component is not aligned with the flow aperture 1206 in the second gating component to prevent fluid flow 184 therethrough. When the spout 16 is in the use position the flow aperture 701 in the first gating component 70 is aligned with the flow aperture 1206 in the second gating component allowing fluid flow 184 therethrough. According to one embodiment, the first gating component and the second gating component define semicircular apertures 701, 1206. Arcuate portions of the semicircular apertures 701, 1206 in the first gating and second gating component are arranged proximate to the base section of the container.

In use, the PFC is first filled with the liquid to be dispensed via the fill spout 26 after the cap 11 is removed. During the filling process the safety 22 can be activated to open vent valve 80 to allow excess air to exit the PFC. After filling, cap 11 is returned to the spout 26 to prevent spillage. To dispense liquid from PFC, the PFC is elevated by a user's first hand grasping handle 20, and the user's second hand moving spout 16 from its storage position into its use position and the flow control tip 18 is then opened to a desired flow rate. To initiate liquid flow, the safety is activated which, as discussed above, opens the vent valve 80 and also unlocks the activator 24 for movement. The activator is slid or pressed into its use position and the internal valve 110 is opened, which allows liquid to flow through the spout 16. Thus, as will be appreciated once the spout is moved and the control tip is opened, pouring operation is performed as a single-hand motion, i.e. by a user's thumb on the first, grasping hand to activate element 24 and the index finger on the grasping hand activating the trigger 22.

Figure 22:
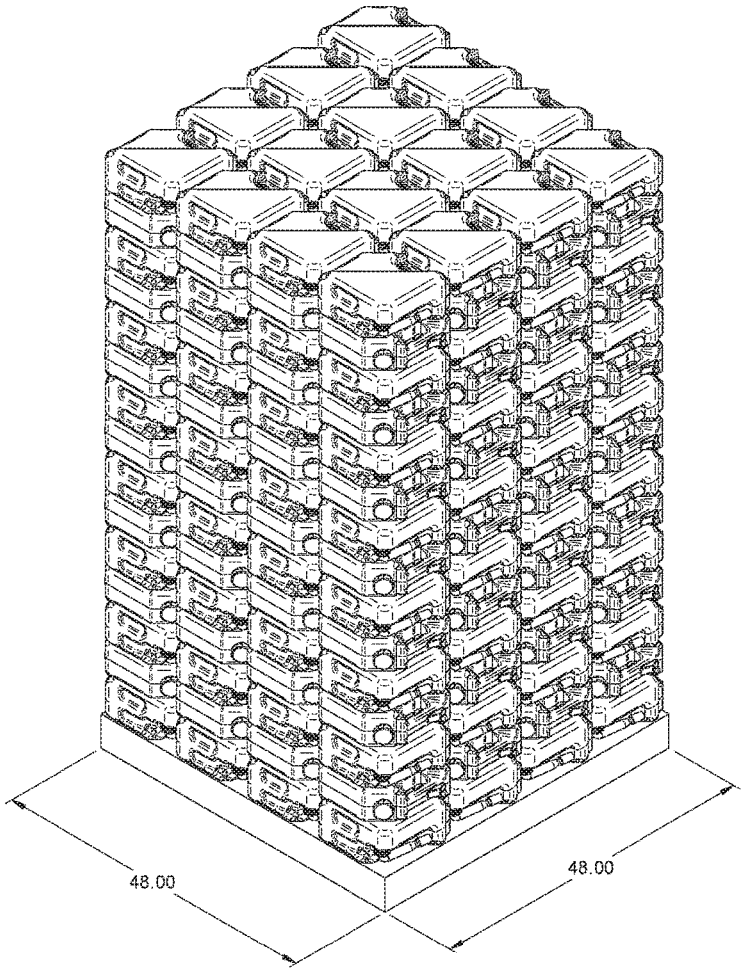
FIG. 22 is a perspective view of a pallet of stacked PFCs.
Figure 23:
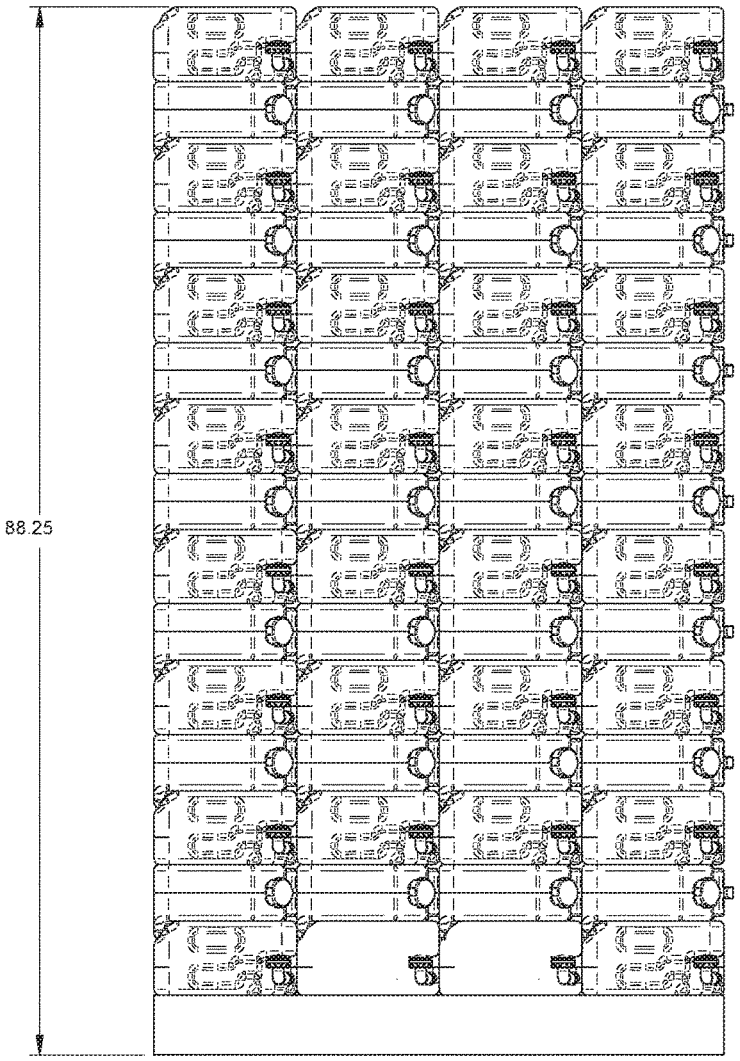
FIG. 23 is side view of a pallet of stacked PFCs.

FIG. 22 is a perspective view of a pallet of stacked PFCs. When stacked, the PFCs are approximately 48"×48". FIG. 23 is side view of a pallet of stacked PFCs. The stacked PFCs are approximately 88 inches tall. Preferably approximately 240 2-gallon containers can be stacked on a single pallet.

Figure 24A:
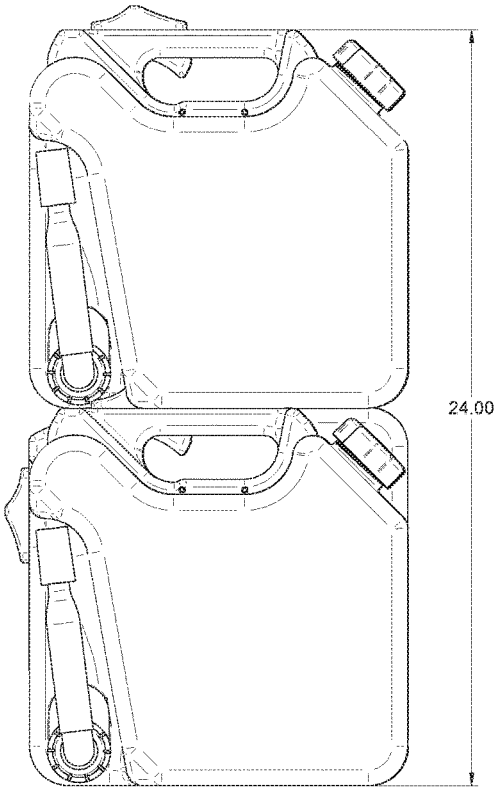
FIGS. 24A-24F shows different volume PFCs stacked together.
Figure 24B:
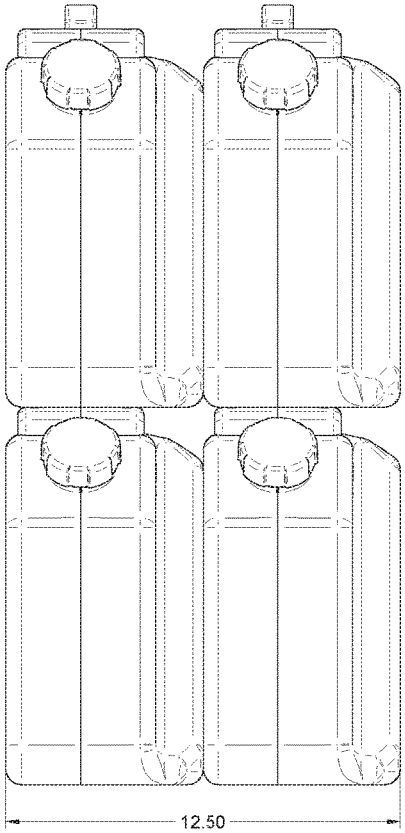
Figure 24C:
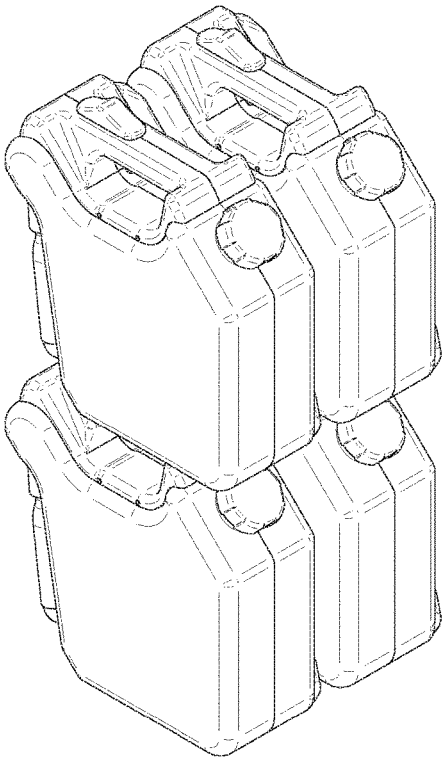
Figure 24D:
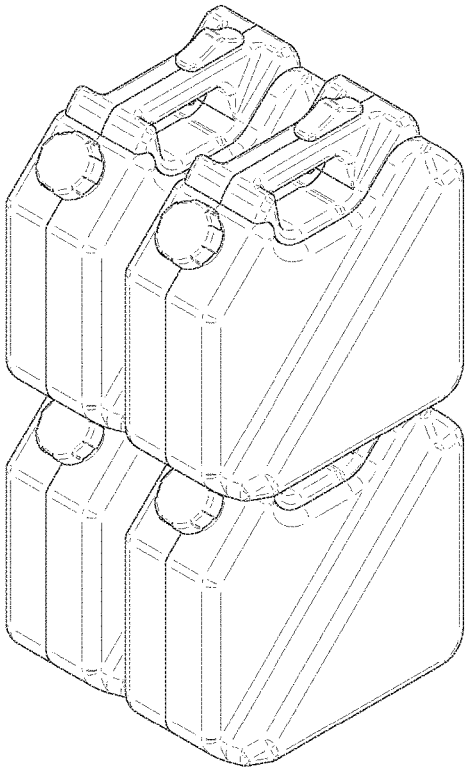
Figure 24E:
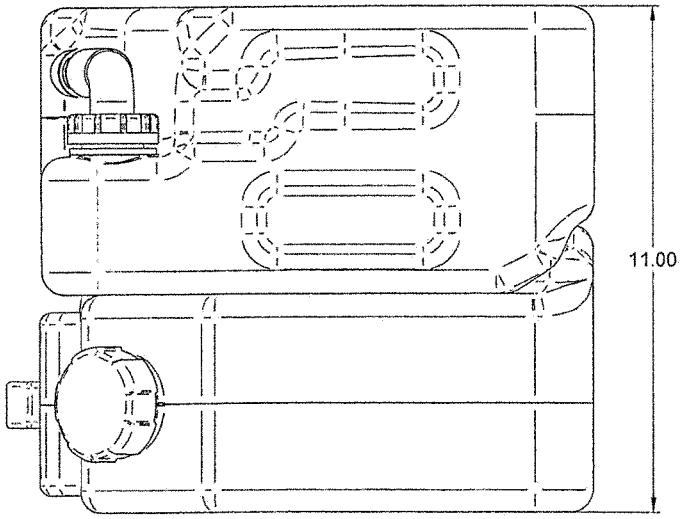
Figure 24F:
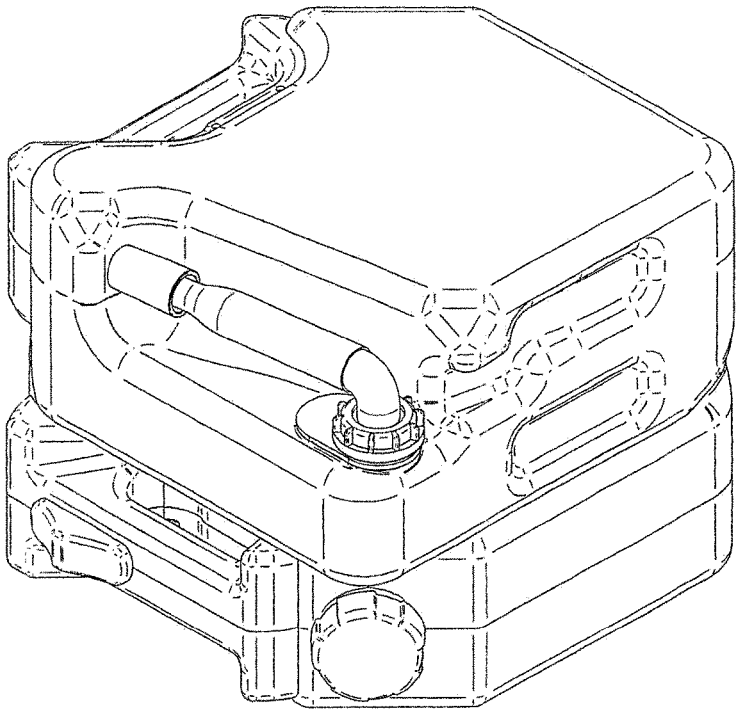

FIGS. 24A-24F show different PFCs stacked. FIG. 24A shows PFCs stacked on their respective diagonal steps 28. FIGS. 24B-24D shows vertically stacked PFCs. Typically the vertically stacked PFCs would be filled. The bottoms are the PFCs are molded to mate with the tops of the PFCs to aid in stacking and stability. FIG. 24E shows PFCs stacked on their respective diagonal steps 28. As shown in FIGS. 24E and 24F, the bottom of the PFC is patterned. The pattern corresponds with the top of the PFC for example, the indent in the bottom of the PFC is configured to accommodate the handle an actuator of another PFC upon which it is stacked. Thus, the PFC is configured for vertical stacking or horizontal stacking.

The invention is not limited by the embodiments described above which are presented as examples only but can be modified in various ways within the scope of protection defined by the appended patent claims. Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A fluid container comprising:

a body comprising:

a pair of opposite sidewall regions;

a front wall connecting the pair of opposite sidewall regions;

a rear wall connecting the pair of opposite sidewall regions;

a top section comprising a sealable opening; and a base section opposite the top section;

a handle arranged in the top section and comprising:

a flow trigger; and a safety trigger configured to interact with the flow trigger and prevent activation of the flow trigger;

a vent assembly configured to be activated by the safety trigger and vent the body;

a spout assembly movably coupled to the body and configured to rotate between a use position and a storage position, the spout assembly comprising:

a spout having a tubular portion with a first end proximate the base section and a dispensing end;

a lock mechanism configured to couple the first end of the spout to the body; and a first valve configured to open from a closed position when the spout assembly is in the storage position to an open position as the spout assembly is moved from the storage position to the use position, wherein fluid flow is prevented by at least the first valve when the spout assembly is in the storage position;

a second valve arranged upstream of the first valve in a flow direction to control fluid flow into the spout assembly; and a linkage mechanism coupled between the flow trigger and the second valve and configured to open the second valve when the flow trigger is activated and the safety trigger is released.

2. The fluid container of claim 1, wherein the flow trigger is movably coupled to the handle and the safety trigger is configured to engage with the flow trigger to prevent movement of the flow trigger.

3. The fluid container of claim 2, wherein the flow trigger is slidably coupled to the handle and the safety trigger is pivotably coupled to the handle and configured to engage with the flow trigger to prevent sliding movement of the flow trigger.

4. The fluid container of claim 1, wherein the second valve comprises:

a seat defining an aperture;

a movable flap configured to mate with the seat; and an attachment element configured to couple the movable flap to the linkage mechanism.

5. The fluid container of claim 4, wherein the movable flap is configured to pivot with respect to the seat.

6. The fluid container of claim 5, wherein the movable flap comprises a gasket configured as a seal between the movable flap and the seat.

7. The fluid container of claim 1, wherein the first valve comprises:

a first gating component defining a flow aperture; and a second gating component defining a flow aperture and configured to rotate with the spout assembly, wherein when the spout assembly is in the storage position the flow aperture in the first gating component is not aligned with the flow aperture in the second gating component to prevent fluid flow therethrough, and wherein when the spout assembly is in the use position the flow aperture in the first gating component is at least partially aligned with the flow aperture in the second gating component allowing fluid flow therethrough.

8. The fluid container of claim 7, wherein the first gating component and the second gating component define semicircular apertures.

9. The fluid container of claim 8, wherein arcuate portions of the semicircular apertures in the first gating component and the second gating component are arranged proximate to the base section.

10. The fluid container of claim 7, wherein the first gating component is one of:

fixed to define a maximum flow position of the spout assembly in the use position, and adjustable to vary a maximum flow position of the spout assembly in the use position.

11. The fluid container of claim 1, wherein the spout assembly is arranged in a recess of the body.

12. The fluid container of claim 1, wherein the spout assembly further comprises:

an angled portion arranged between the tubular portion and the body; and a lip extending radially from the angled portion and configured to be sandwiched between the lock mechanism and the body.

13. The fluid container of claim 1, wherein the spout assembly further comprises:

a flow control tip threadingly attached to the dispensing end of the tubular portion.

14. The fluid container of claim 1, wherein the linkage mechanism comprises:

an axle configured to rotate about its longitudinal axis;

a horizontally extending arm having a first end coupled to the axle and a second end coupled to the flow trigger; and a vertically extending arm having a first end coupled to the axle and a second end coupled to the second valve, wherein the horizontally extending arm and the vertically extending arm are longitudinally offset from one another along the axle and wherein horizontal movement of the horizontally extending arm is translated into vertical movement of the vertically extending arm.

15. The fluid container of claim 14, wherein the axle, the horizontally extending arm, and the vertically extending arm are molded as a single component.

16. The fluid container of claim 14, wherein the axle, the horizontally extending arm, and the vertically extending arm bias the second valve in a closed position.

17. The fluid container of claim 15, wherein the second end of the vertically extending is coupled to the second valve by an extension arm.

18. The fluid container of claim 1, further comprising a fill spout arranged in the top section of the body; and a removable cap configured to seal the fill spout.

19. The fluid container of claim 1, wherein at least one of the pair of opposite sidewall regions comprises a stacking and mating feature.

20. The fluid container of claim 1, wherein the stacking and mating feature comprises a diagonal step.

21. The fluid container of claim 1, wherein the base section is configured to be at least partially complementary to the top section to allow stacking.

* * * * *